US010856632B2

(12) United States Patent
Davis et al.

(10) Patent No.: US 10,856,632 B2
(45) Date of Patent: Dec. 8, 2020

(54) LUGGAGE ARTICLES AND COMBINATIONS THEREOF

(71) Applicant: RJH Creative Solutions LLC, Columbus, GA (US)

(72) Inventors: Robert P Davis, Vidalia, GA (US); Rashmi Jain Hudson, Columbus, GA (US)

(73) Assignee: RJH Creative Solutions LLC, Columbus, GA (US)

( * ) Notice: Subject to any disclaimer, the term of this patent is extended or adjusted under 35 U.S.C. 154(b) by 45 days.

(21) Appl. No.: 15/900,469

(22) Filed: Feb. 20, 2018

(65) Prior Publication Data

US 2019/0254398 A1 Aug. 22, 2019

(51) Int. Cl.

| | |
|---|---|
| ***A45C 7/00*** | (2006.01) |
| ***A45C 3/00*** | (2006.01) |
| ***A45C 9/00*** | (2006.01) |

(52) U.S. Cl.

CPC ..... *A45C 7/0086* (2013.01); *A45C 3/004* (2013.01); *A45C 2009/007* (2013.01)

(58) Field of Classification Search

CPC .. A45C 7/0086; A45C 3/004; A45C 2009/007
See application file for complete search history.

(56) References Cited

U.S. PATENT DOCUMENTS 2,261,291 A * 11/1941 Salavsky ..... A45C 3/004 190/113
3,115,959 A 12/1963 Jaffe
3,729,038 A * 4/1973 Ekeson ..... A45C 7/0045 190/110
3,831,740 A 8/1974 Pendergast
3,837,447 A * 9/1974 Honan ..... A45C 5/00 190/110
4,170,282 A * 10/1979 Schwartzstein ..... A45C 7/0086 190/108
4,189,036 A 2/1980 Pelavin
4,206,835 A * 6/1980 Shapiro ..... A45C 3/004 190/1
D267,677 S * 1/1983 Pelavin ..... 190/102
4,436,189 A * 3/1984 Baum ..... A45C 3/004 190/108
D273,911 S * 5/1984 Pelavin ..... 190/102
4,502,576 A 3/1985 Reardon
4,542,824 A 9/1985 Allen
(Continued)

FOREIGN PATENT DOCUMENTS

| | | |
|---|---|---|
| CA | 1119132 | 3/1982 |
| GB | 2243764 | 11/1991 |

*Primary Examiner* — Tri M Mai
(74) *Attorney, Agent, or Firm* — Thomas G. Peterson; Maynard Cooper & Gale

(57) ABSTRACT

A light-weight, easily portable luggage combination is described. The combination comprises a garment bag and a general purpose bag and optionally a utility bag, wherein the garment bag and general purpose bag may be reversibly secured together or used separately if desired. The combination provides for a first interior space in the garment bag so that hanging clothes can be stored in the garment bag and a second interior space in the general purpose bag so that other items (for example, clothing, shoes, accessories, and toiletries) can be stored separately from the hanging clothes.

32 Claims, 14 Drawing Sheets

(56) References Cited

U.S. PATENT DOCUMENTS

| | | | | |
|---|---|---|---|---|
| 4,598,803 | A * | 7/1986 | Ghiassi | A45C 7/0086 190/102 |
| D292,745 | S | 11/1987 | Allen | |
| 4,817,791 | A | 4/1989 | Adams | |
| 4,898,274 | A * | 2/1990 | Stout | A45C 3/004 190/108 |
| 5,090,559 | A | 2/1992 | Gendreau | |
| 5,547,052 | A * | 8/1996 | Latshaw | A45C 5/14 16/113.1 |
| 6,223,367 | B1 | 5/2001 | French | |
| 7,416,066 | B2 * | 8/2008 | Chernoff | A45C 3/004 190/108 |
| 8,201,684 | B2 | 6/2012 | Torrellas | |
| 8,235,206 | B2 | 8/2012 | Siegel | |
| D778,049 | S | 2/2017 | Kogelnik | |
| 9,936,779 | B1 | 4/2018 | Hudson | |
| 2010/0032459 | A1 | 2/2010 | Clark | |
| 2017/0020250 | A1 * | 1/2017 | Boschan | A45C 5/06 |

* cited by examiner

LUGGAGE ARTICLES AND COMBINATIONS THEREOF

BACKGROUND OF THE DISCLOSURE

Field of the Disclosure

The present disclosure relates generally to a luggage combination and specifically to a luggage combination comprising a garment bag, a general purpose bag and optionally a utility bag, wherein the garment bag may be reversibly secured to the general purpose bag for use as a combination and wherein the garment bag and general purpose bag may be used independently of one another.

Background

Individuals in today's society are confronted with the need to transport clothing items and other items on a variety of occasions. These occasions can include lengthy vacations, overnight business travel, quick weekend trips with friends and family, local events requiring a change of wardrobe (such as a wedding or dance recital), morning exercise classes or trips to or from the dry cleaner. A wide variety of bags may be used for transporting such items, and the destination or purpose may dictate the specific transportation needs. For example, a lengthy vacation may require a significant amount of sturdy luggage. A quick business trip may require an overnight bag or a garment bag to protect business attire. A weekend car trip may require the ability to carry a few hanging gaunents as well as shoes, accessories, and toiletry bags. A local wedding or dance recital may require the ability to carry formal wear or recital clothing and the appropriate footwear and accessories. A trip to an exercise class may require a change of clothing, additional accessories, or specific exercise equipment. A trip to or from the dry cleaner may require a bag that is suitable for carrying dirty laundry to the cleaner and clean clothing back. All of the aforementioned bags are typically designed to perform only one type of travel and when one travels on a trip that incorporates more than one type of travel, multiple bags are required for various types of clothing. Furthermore, it is desirable to transport clothing items in a manner that minimizes wrinkling of the clothing items during transport.

Many luggage pieces are designed such that the luggage pieces may be taken aboard an aircraft and stored in an overhead bin. For example, some garment bags are designed to be folded to facilitate carrying and to allow the bags to be taken as carry-on luggage on an aircraft. Generally, such garment bags are designed to fold in half, with a closure mechanism to maintain the folded configuration. Typical prior art garment bags when folded onto themselves during use create significant wrinkles in the clothing items during transport, resulting in the user having to remove the wrinkles before wearing the item of clothing or wearing the clothing items with wrinkles. FIG. 1 illustrates a prior art garment bag 1000 having a first 1002 and a second 1004 end secured to one another by closure 1008, creating the sharp fold 1006 that causes wrinkles in clothing.

Prior art garment bags have included zippered compartments or pouches for holding small items. Such compartments may be on the interior or exterior of the bag, or both. In some cases, the pouches or compartments may be large enough to accommodate shoes or accessories. Such bags may be unsuitable for carrying additional items of clothing necessary for a trip, or for carrying accessories or toiletries, and therefore a second bag is necessary to accommodate these items.

In some cases, a prior art bag may incorporate another piece of luggage suitable for carrying additional items. Such bags are generally quite bulky due to the combined bulk of a large, sturdy garment bag, and equally sturdy suitcase or duffle. Some such bags have incorporated hard-sided luggage resembling a briefcase. The overall effect has been a bulky, heavy, and generally unwieldy luggage combination that is generally undesirable for an individual with only a few items to carry, such as an individual making a short trip, or one making a local trip that requires a change of clothing. Often this configuration is bulky and can limit the areas in which the garment bag may be stored during transport (for example, the garment bag may be too bulky to fit in the overhead storage bin of an airplane). Furthermore, such prior art bags are not considered a single piece of carry-on luggage by the majority of airlines. When a luggage piece will not fit in the designated overheard storage bin of an aircraft or is considered to separate pieces of luggage, a user may be required to check the bag with the airline (preventing the luggage piece from being stored in the overhead bin of the aircraft) and requiring the user to retrieve the luggage piece from the luggage carousel. This creates additional delay as the user must wait for the luggage piece to be unloaded and navigate the airport to the designated area where the luggage piece is made available for retrieval. Additional expense may also be incurred as the majority of airlines now charge significant fees for each item of luggage that is checked.

There remains a need for a light-weight versatile luggage combination which is capable of transporting clothing items and other items that allows for a compact configuration of two separate pieces (for example, a garment bag and a general purpose bag) during use and allows convenient and easy transportation of hanging garments, other items of clothing, shoes, and accessories. In addition, there is a need for a luggage combination that eliminates the fold in prior art garment bags when configured for storage during transport (such as in the overhead bin of an aircraft) and minimizes wrinkling of the transported clothing items. Still further, there is a need for a luggage combination that dimensioned such that the luggage combination fits in an overhead storage bin on an aircraft eliminating the need for a user to check baggage (which allows the user to skip the baggage pick-up process and save on baggage fees). Even further, is there is a need for a luggage combination that is considered a single piece of carry-on luggage, eliminating the need for a user to check an extra piece of luggage (which allows the user to skip the baggage pick-up process and save on baggage fees). Furthermore, there is a need for a luggage combination manufactured from non-rigid materials. In one embodiment, the garment bag, the general purpose bag and the optional utility bag are manufactured from non-rigid materials, allowing the individual pieces and/or the combination to flex and conform to the space the individual pieces and/or combination are being stored. The present invention addresses all or a combination of these needs.

SUMMARY OF THE DISCLOSURE

The present invention addresses the needs in the art by providing a luggage combination comprising a garment bag and a general purpose bag, wherein the garment bag and general purpose bag may be reversibly secured together to form a compact configuration or used separately if desired.

The luggage combination provides for a first interior space in the garment bag so that hanging clothes can be stored in the garment bag and a second interior space that is completely independent of the first interior space in the general purpose bag so that other items (for example, clothing, shoes, accessories, and toiletries) can be stored separately from the hanging clothes. The compact configuration also eliminates the fold in prior art garment bags as shown in FIG. 1, thereby minimizing wrinkling of the transported clothing items. As described herein, the garment bag wraps around general purpose bag allowing fat nation of the compact configuration without forming a sharp bend or an acute angle (an angle greater than 0 degrees but less than 90 degrees) in the garment bag. The compact configuration also allows for the components of the compact configuration (for example, the garment bag and the general purpose bag) to be considered a single piece of luggage when carried on an aircraft. As such, the use of the luggage combination in the compact conformation allows the user to save money by eliminating baggage fees for the pieces of the luggage combination and provides convenience by allowing the user to skip the baggage claim process for checked luggage. The luggage combination forms a compact configuration when reversibly secured together that allows for easy transport and storage (for example, in the overhead bin of an aircraft).

The general purpose bag is used herein for simplicity, however it is understood that the term "general purpose bag" is exemplary of the concept described and is not limiting to the type of bag that may be used in the luggage combination disclosed herein. Furthermore, unless specified otherwise herein, the garment bag and general purpose bag are constructed using materials common in the art using methods common in the art. The garment bag and general purpose bag comprising the combination may also further comprise additional features known for use in such articles in addition to the features described herein (provided that such additional features do not interfere with the novel properties of the luggage combination described herein).

Because the garment bag and general purpose bag are detachable from one another, packing of each is convenient. When the garment bag and general purpose bag are ready for travel, the garment bag and general purpose bag may be combined in the combination to provide a compact configuration as described herein so that the luggage combination is easy and convenient to transport and carry and may be used as a single piece of carry-on luggage (for example, on an aircraft). The luggage combination may be carried by a user in several ways as described herein, including by the use of a carrying assembly (for example, a handle on the general purpose bag) or a shoulder strap that is secured to the general purpose bag or garment bag. Once the individual arrives at the destination, the garment bag and general purpose bag may be separated from one another for unpacking.

The luggage combination optionally comprises a utility bag. The utility bag, when present may be used for packing desired articles (either on its own or for packing in the garment bag or general purpose bag as disclosed herein) or simply stored in the garment bag or general purpose bag. The utility bag provides several features. First, the utility bag may be used to store clothing worn during a trip in one location so that articles of clothing are not lost during travel. Second, the utility bag may be used to pack clothing worn during a trip to keep it separated from the clean clothing and packed in the garment bag or general purpose bag. Third, the utility bag may also serve as a storage device for the garment bag and general purpose bag when not in use. Fourth, the utility bag may also conveniently be used to carry items when on a trip (for example, to carry personal items during an outing), obviating the need to pack an additional bag for use during the trip.

DETAILED DESCRIPTION

FIGS. 2A to 8C will be used as reference to describe certain embodiments of the garment bag of the present disclosure. FIGS. 2A to 8C are illustrative in nature and are not meant to limit the present disclosure to the embodiments illustrated.

Figure 1:
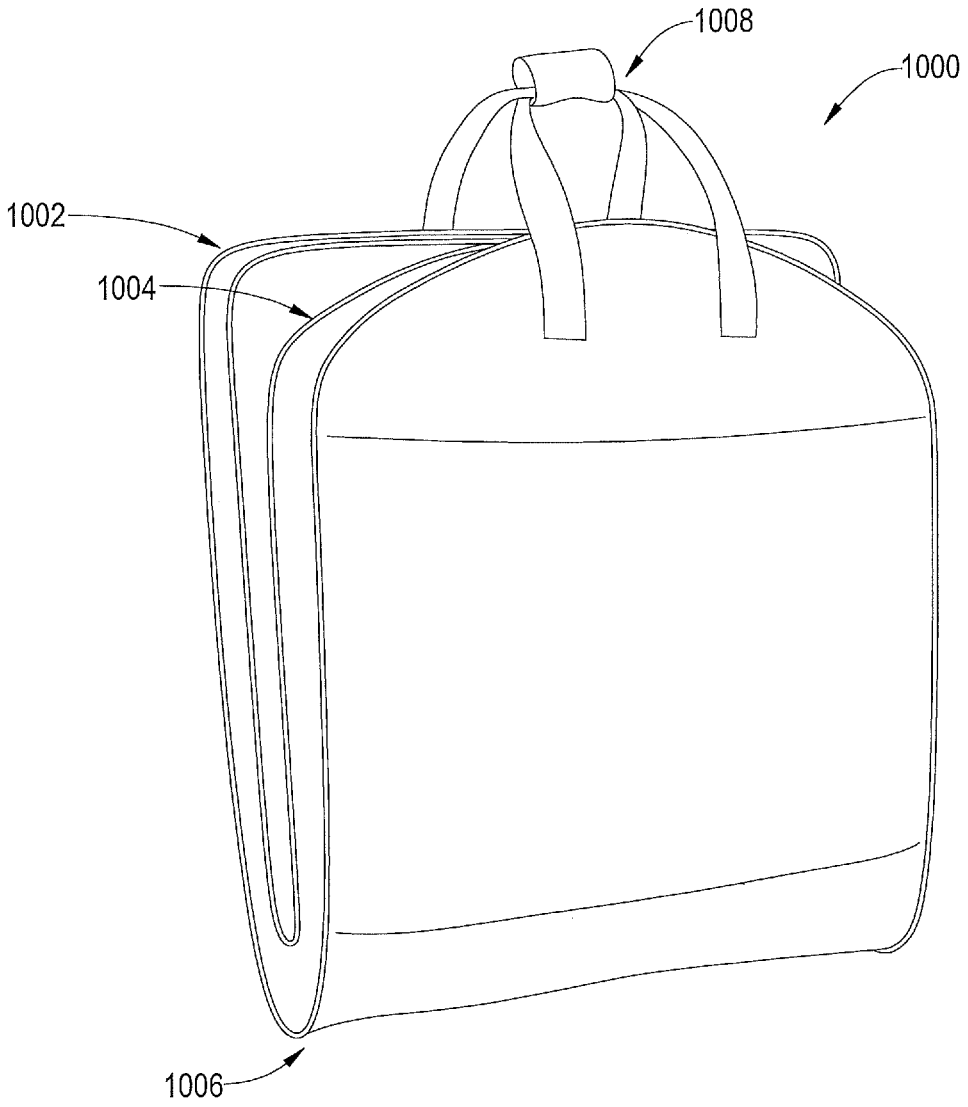
FIG. 1 Prior Art
FIG. 1 shows a prior art garment bag in a folded configuration.

The present disclosure provides a luggage combination comprising a garment bag and a general purpose bag, wherein the garment bag and general purpose bag are each usable as separate articles of luggage and are usable together as a combination. The garment bag and the general purpose bag are reversibly secured to one another to form the combination. The luggage combination forms a compact configuration when reversibly secured to one another that allows for easy transport and storage (for example, as a single carry-on luggage piece in the overhead bin of an aircraft). In the compact configuration, the garment bag does not have the reverse fold or other sharp fold (see FIG. 1) present in prior art garment bags. As a result, the wrinkling of the clothing items stored in the garment bag when a part of the compact configuration is minimized or eliminated.

In one embodiment, in the compact configuration the garment bag and the general purpose bag are reversibly secured to one another through at least one point of connection. In one embodiment, in the compact configuration the garment bag and the general purpose bag are reversibly secured to one another through at least two points of connection. In one embodiment, in the compact configuration the garment bag and the general purpose bag are reversibly secured to one another through at least three points of connection. In one embodiment, in the compact configuration the garment bag and the general purpose bag are reversibly secured to one another through exactly two points of connection or exactly three points of connection.

In one embodiment, in the compact configuration the garment bag s reversible secured to itself through at least one point of connection. In one embodiment, in the compact configuration the garment bag is reversibly secured to itself through at least two points of connection. In one embodiment, in the compact configuration the garment bag is reversibly secured to itself through at least three points of connection. In one embodiment, in the compact configuration the garment bag is reversibly secured to itself through exactly one point of connection or exactly two points of connection.

In one embodiment, the garment bag and the general purpose bag are reversibly secured to one another through at least one point of connection and the garment bag is reversible secured to itself through at least one point of connection, such as two points of connection. In one embodiment, the garment bag and the general purpose bag are reversibly secured to one another through at least two points of connection and the garment bag is reversible secured to itself through at least one point of connection, such as two points of connection. In one embodiment, the garment bag and the general purpose bag are reversibly secured to one another through at least three points of connection and the garment bag is reversibly secured to itself through at least one point of connection, such as two points of connection. In one embodiment, the garment bag and the general purpose bag are reversibly secured to one another through at least three points of connection and the garment bag is reversibly secured to itself through at least two points of connection. In one embodiment, the garment bag and the general purpose bag are reversibly secured to one another through three points of connection and the garment bag is reversibly secured to itself through two points of connection.

In describing the manner in which the garment bag and/or general purpose bag may be joined to one another in the combination, the following terms may be used. The terms "permanently secured," "permanently joined" and "joined/secured in a permanent manner" mean that the components/pieces are joined to one another in a manner that the components/pieces will not become separated from one another by the actions of a user during normal use without the application of a destructive force (for example, application of a cutting force by a person or the environment). Any means known in the art may be used to permanently join components/pieces, such as but not limited to, stitching, adhesives or lamination. The terms "reversibly secured," "reversibly joined" and "joined/secured in a reversible manner" means the components/pieces are joined to one another in a manner such that a user may easily separate or detach one component/piece from the other. Any means known in the art may be used reversibly join components/pieces, such as but not limited to, hooks and rings, zippers, snaps, grommets, buttons, hook-loop fasteners (for example, Velcro), fasteners and the like.

The specification uses the term mating assembly (for example a garment bag mating assembly or a garment bag general purpose bag mating assembly, which is also referred to herein as a combination mating assembly) to describe the elements which reversibly secure pieces of a single article (for example, the ends of the garment bag) and/or to the elements which reversibly secure the components of the luggage combination (for example, the garment bag and the general purpose bag). A variety of mating assemblies are known in the art and they comprise elements that are configured to cooperatively interact with one another to reversibly secure the described articles. As such, each mating assembly can be considered to have a first portion and a second portion that are configured to cooperatively interact with one another (it being understood that the first portion and the second portion are simply meant to refer to one-half of the mating assembly, without specifying the structure of the first and second portions). It is also understood that the term "first portion" and "second portion" may refer to an assembly composed of multiple parts or a single part. For example, a first portion may be a male element of a snap and the second portion may be a female element of the snap (and the terms refer to a single element). As another example, the first portion may be a strap with a male portion of a quick release buckle secured thereto and the second portion may be a strap with a female portion of the quick release buckle secured thereto (and the terms refer to a combination of elements). A variety of mating assemblies are known in the art and any of the mating assemblies known in the art may be used in the garment bag, general purpose bag and luggage combination described herein. Exemplary mating assemblies include, but are not limited to, zippers, grommet and stud combination, a magnet combination (for example, a magnet and a base with which the magnet interacts or two magnets of opposing polarity), ring and hook combination, snaps, button/buttonhole combination, button/frog combination, ties, straps, buckles, quick release buckles (for example, cooperating portions of a quick release buckle secured to a strap) and hook/loop fasteners (for example, Velcro®). In certain portions of the specification, a preferred mating assembly may be described. It is to be understood that such a preferred mating assembly is used for illustration only and should not be considered as limiting the mating assembly to the preferred mating assembly unless explicitly stated.

In a particular embodiment, the luggage combination is dimensioned such that compact configuration of the luggage combination meets the size threshold to be stored in the overhead bin of an aircraft. While the size thresholds for storage in overhead bins of aircraft vary by aircraft type and air carrier, the garment bag and general purpose bag may be manufactured with any dimension desired to fit a desired overhead compartment space. In a particular embodiment, the garment bag and general purpose bag are dimensioned such that the luggage combination in the compact configuration meets a size threshold of 22 in×14 in×9 inches (this size threshold is currently used by Delta Airlines, United Airlines, American Airlines, Jet Blue, Virgin Atlantic and many other US domestic air carriers). In another particular embodiment, the garment bag and general purpose bag are dimensioned such that the luggage combination in the compact configuration meets a size threshold of 24 in×17 in×10 inches. In another particular embodiment, the garment bag and general purpose bag are dimensioned such that the luggage combination in the compact configuration meets a size threshold of 24 in×16 in×10 inches. In another particular embodiment, the garment bag and general purpose bag are dimensioned such that the luggage combination in the compact configuration meets a size threshold of 24 in×16 in×11 inches. In another particular embodiment, the garment bag and general purpose bag are dimensioned such that the luggage combination in the compact configuration meets a size threshold of 22 in×18 in×10 inches. In one embodiment of the foregoing, the dimensions provided may be considered L×W×H. In another particular embodiment, the garment bag and general purpose bag are dimensioned such that the luggage combination in the compact configuration meets a size threshold of 45 or 46.5 linear inches (all dimensions). The foregoing measurements refer to the dimensions of the luggage combination described herein. However, the dimensions of the garment bag and or general purpose bag are also governed by such dimensions as they form a part of the combination. For example, if the luggage combination meets a size threshold of 22 in×14 in×9 inches, the width of the garment bag and/or general purpose bag will not exceed 14 inches. It should be noted that certain dimensions of the garment bag and/or general purpose bag may exceed the maximum dimensions provided above. For example, the length of the garment bag alone (i.e., outside of the compact configuration) may be greater than the maximum length specified as length of the garment bag is reduced in the compact configuration as shown herein.

The features of the garment bag and general purpose bag are described separately below. The garment bag and the general purpose bag are adapted to be reversibly secured to one another.

Garment Bag

Figure 2A:
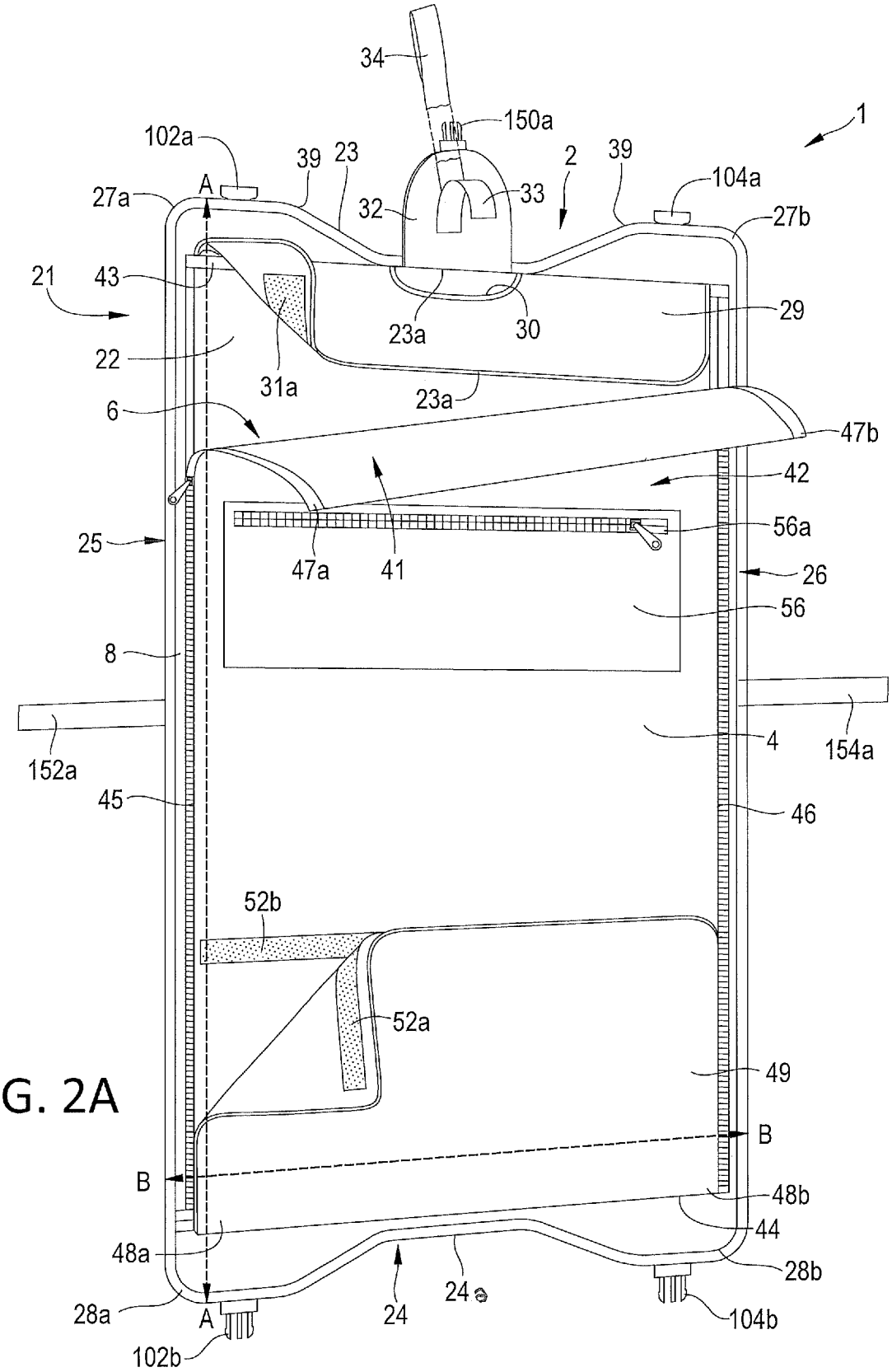
FIG. 2A shows a perspective view of an exemplary embodiment of a garment bag of the present disclosure, illustrating the interior face of the primary panel and the interior panel.

The garment bag 1 may be of any shape known in the art. In one embodiment, the garment bag 1 has a generally rectangular shape (FIGS. 2A and B and 3). In one embodiment, the garment bag 1 has a length that is greater than its width. In a particular embodiment, the garment bag has a length from between 30 and 50 inches and a width of between 15 and 26 inches. In a particular embodiment, the garment bag has a length from between 36 and 42 inches and a width of between 19 and 22 inches In a particular embodiment, the garment bag has a length that is less than 2.5-fold its width or less than 2-fold its width. In the above descriptions, the length is measured form the outer edge of the first 23 and second 24 primary ends (line A-A) and does not include the length of the optional extension pocket 49 as described herein), and the width is measured from the outer edge of the first 25 and second 26 primary edges (line B-B) (as such terms are described herein and as illustrated in FIG. 2A to FIG. 8C).

In one embodiment, garment bag 1 comprises a primary panel 2, an interior panel 4, a first interior space 6 (at least a portion of which is formed by the primary panel 2 and the interior panel 4), at least one reversibly sealable opening 8 to access the first interior space 6, at least one garment bag mating assembly (shown as 102*a* and *b* and 104*a* and *b*) secured to the primary panel 2 and/or the interior panel 4 and a portion of at least one combination mating assembly (shown as 152*a* and 154*a*) secured to the primary panel 2 or the interior panel 4 (FIG. 2A).

Figure 3:
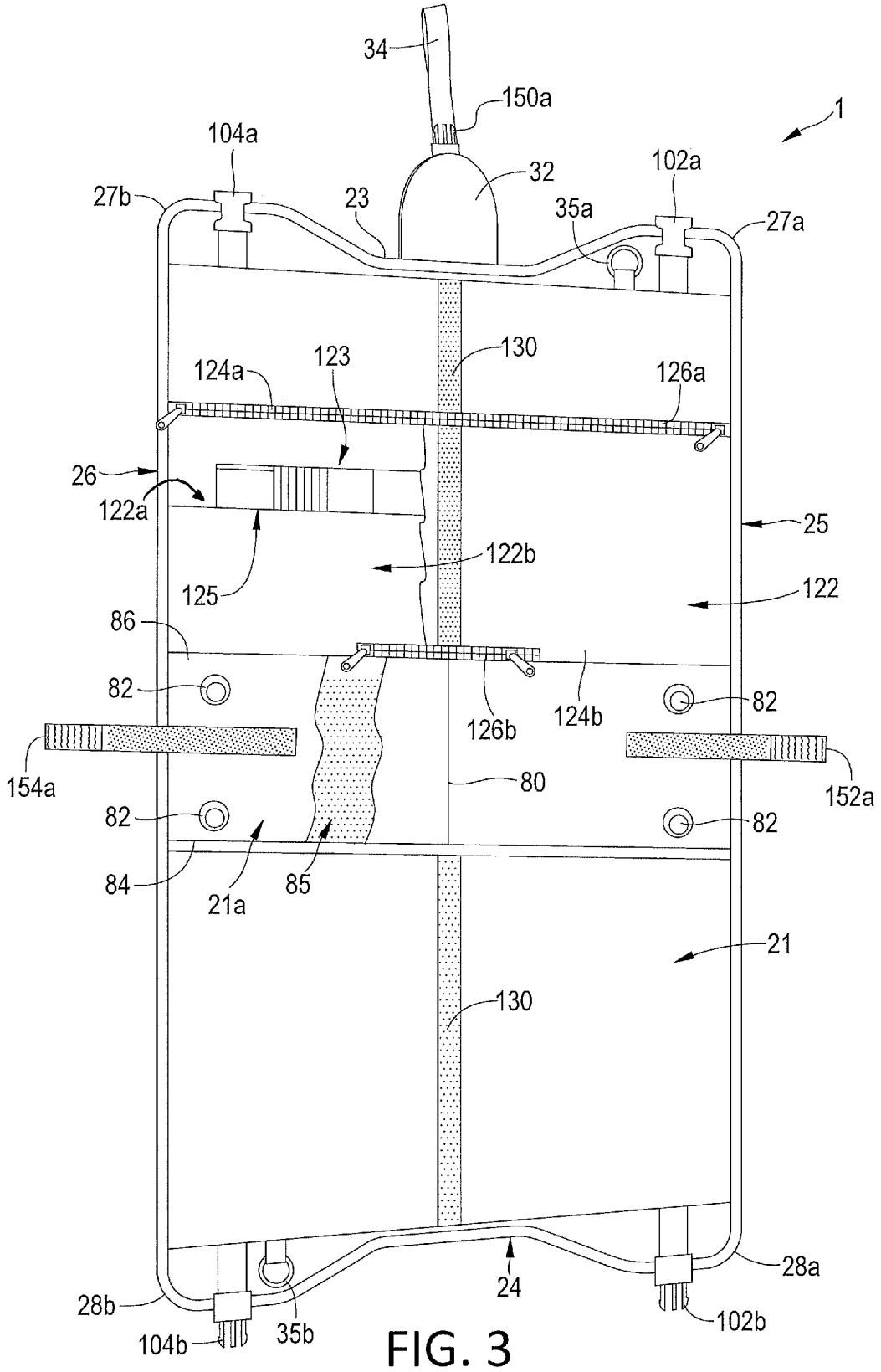
FIG. 3 shows a perspective view of an exemplary embodiment of a garment bag of the present disclosure, illustrating the exterior face of the primary panel.

The garment bag 1 may be manufactured from any material known in the art. In one embodiment, the garment bag 1 is manufactured from a cloth fabric or a polymer material. In one embodiment, the garment bag 1 may be manufactured from two or more materials. For example, the primary panel 2 may have an exterior face 21 comprising a polymer material (such as, for example, nylon) and the interior face 22 may be manufactured from a different polymer material (such as, for example, polyester). The material from which the garment bag 1 is manufactured may also be treated to be stain resistant (such as, for example, with Teflon), water resistant and/or fire retardant. Furthermore, the garment bag 1 as manufactured may comprise one or more design elements 130 for aesthetic and functional appeal. In certain embodiments, the design element 130 is a part of the material from which the garment bag 1 is manufactured. For example, the design element 130 may aid in identification of the garment bag at a distance or when retrieving the garment bag from a storage area. In one embodiment, the design element 130 is a geometric design, such as one or more stripes placed on the exterior face of the primary panel 2 (FIG. 3).

In one embodiment, the primary panel 2 comprises an exterior face 21, an interior face 22, first 23 and second 24 primary ends and first 25 and second 26 primary edges. In one embodiment, the first 23 and second 24 primary ends and the first 25 and second 26 primary edges form a pair of primary upper corners 27*a* and 27*b* and a pair of primary lower corners 28*a* and 28*b* such that the primary panel 2 has a generally rectangular shape. The primary panel may further comprise additional elements as described herein, such as the components of the mating assemblies.

In certain embodiments, at least one of the first 23 and second 24 primary ends has an arcuate or curved shape 39 to define a gap 70 (shown in FIGS. 8B to 8C) between the first 23 and second 24 primary ends when the garment bag is a part of the combination with the general purpose bag. In a further preferred embodiment, both of the first 23 and second 24 primary ends have an arcuate or curved shape 39 to define the gap 70. In a preferred embodiment, the arcuate shape is designed such that the gap 70 is centered on the midpoint 23*a* of the first and/or second primary ends and extends to the left and right of such midpoint. The function of the gap 70 is discussed in more detail herein.

In certain embodiments, the primary panel 2 comprises a protecting flap 29. The purpose of the protecting flap 29, when present, is to provide a closure for the first interior space 6 and to provide additional protection for the articles therein. When present, the protecting flap 29 may be secured (preferably permanently secured) to the interior face 22 of the primary panel 2 at or adjacent to the first primary end 23. The protecting flap 29 preferably has slightly less width than the primary panel 2 and contains an opening 30 to allow a hanger or other element on which articles of clothing are placed to extend out of the first interior space 6. The opening 30 is preferably centered on a midpoint 23*a*. In one embodiment, the protective flap 29 is reversibly secured to the outer side 42 of the interior panel 4, with the protecting flap 29 comprising a first portion of an interior mating assembly 31*a* on the inner side of flap 29 and the second portion of the interior mating assembly 31*b* being located on the outer side 42 of the interior panel 4. In one embodiment, the interior mating assembly 31*a* and 31*b* is a hook and loop fastener (although any mating assembly described herein may be used).

In certain embodiments, the primary panel 2 may further comprise a first and/or second portion of one or more combination mating assemblies, preferably located on the exterior face 21 of the primary panel 2 (for example, elements 152*a* and 154*a* in FIG. 3) a first and/or second portion of one or more garment bag mating assemblies, preferably located on the exterior face 21 of the primary panel 2 (for example, elements 102*a* and *b* and 104*a* and *b* in FIG. 3).

Figure 2B:
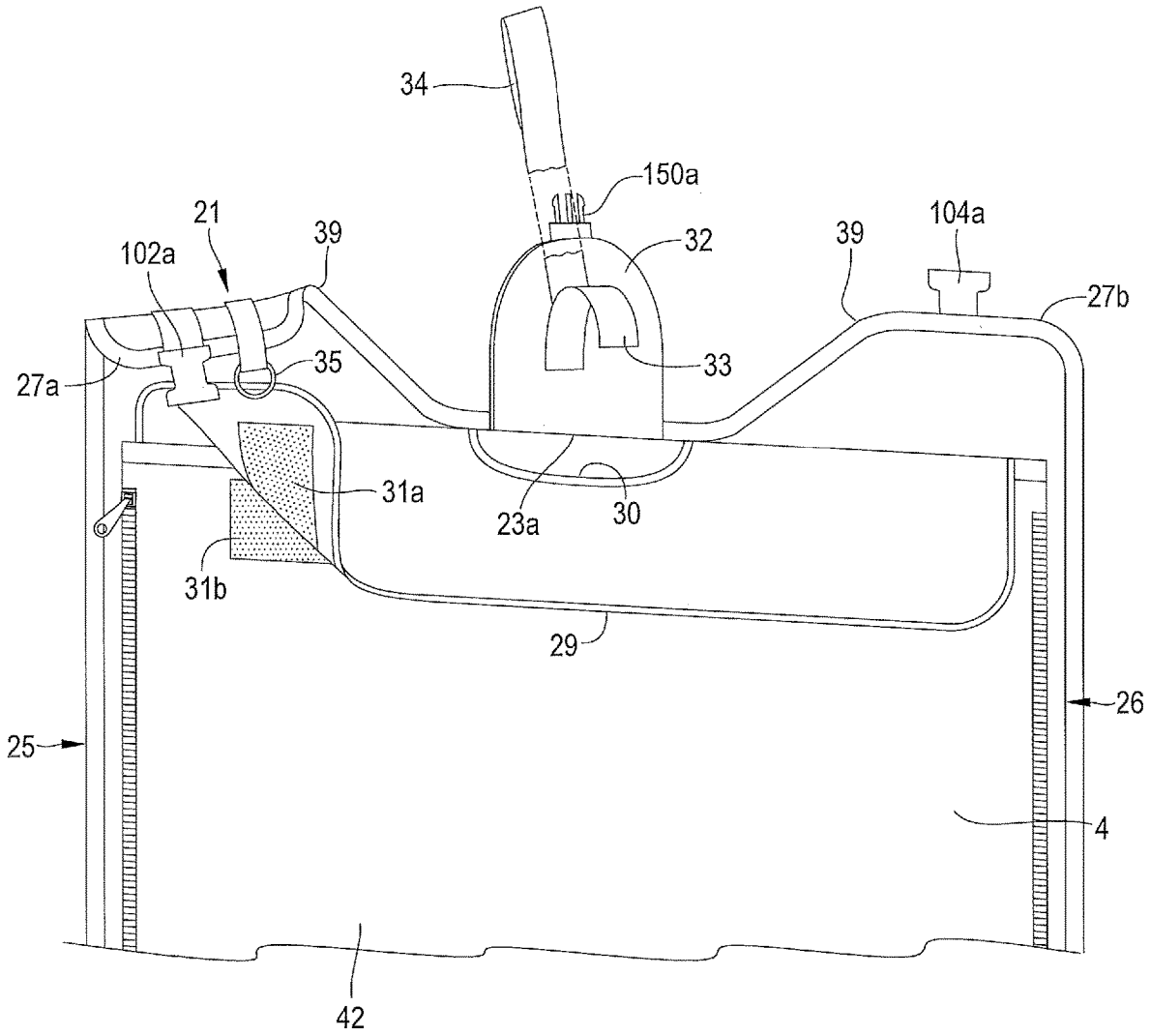
FIG. 2B shows a perspective view of a representative end of an exemplary embodiment of a garment bag of the present disclosure.

In certain embodiments, the primary panel 2 further comprises a tab 32 secured (preferably permanently secured) to the first 23 or second 24 primary ends (in a preferred embodiment, the tab portion is secured to the first 23 primary end). The tab 32 is conveniently secured at or adjacent to midpoint 23*a* of a primary end. The tab 32 has multiple functions. When present, the tab 32 may comprise a first portion of a combination mating assembly 150*a* as described herein (FIG. 2B), and a securing element 33 to secure a hanger or other element on which articles of clothing are placed and a carrying element 34 allowing a user to carry the garment bag 1 (FIG. 2B). In addition, when the garment bag 1 is in combination with the general purpose bag 200 (as described herein), the tab 32 protects a user's hand from contacting the hanger or other element on which articles of clothing are placed (thereby preventing injuries such as cuts and scratches) and prevents the hanger or other element on which articles of clothing are placed from contacting items as well. In certain embodiments, the securing element 33 is a loop hook and loop fastener. In certain embodiments, the carrying element 34 is a loop of fabric.

In certain embodiments, the primary panel 2 further comprises a plurality of receivers 35 for a strap, such as a shoulder strap or the like, to enable the garment bag 1 to be carried by a user (both as a part of the combination and when used alone) (shown for example, in FIGS. 2B and 3). In one embodiment, the receivers 35 are a ring. A shoulder strap may also be provided. The receiving elements may be placed at any location desired, however, in one embodiment a first receiver 35*a* is positioned on or adjacent to an upper primary corner (for example 27*a*) and a second receiver 35*b* is placed on or adjacent to the opposite lower primary corner (for example 28*b*).

In a particular embodiment, the primary panel may further comprise a middle primary panel 21*a* located generally in the middle of the primary panel 2 (FIG. 3). When present, the middle primary panel comprises a break point 80 to allow for folding of the garment bag 1 when not in use (for example, when stored in the utility bag 300). The break point 80 may be oriented vertically with respect to first 23 and second 24 primary ends of the primary panel. In one embodiment, the middle primary panel 21*a* is defined by boundaries 84 and 86 (which may also function as breakpoints), extending from the first 25 to second 26 primary edges, with the break point 80 extending at least partially (in one embodiment, completely) between boundaries 84 and 86. In one embodiment, the middle primary panel 21*a* encloses a section of rigid material 85 (for example, a rigid piece of plastic) to provide structural definition to the garment bag when in the compact configuration. A single piece of rigid material may be used (extending from first 25 and second 26 primary edges and having a break point at the same position as break point 80) or two pieces of rigid material may be used, with a first piece extending from primary edge 25 to break point 80 and a second piece extending from break point 80 to primary edge 26. In a preferred embodiment, the rigid material (whether as a single piece of multiple pieces) extends the entire width of the middle primary panel 21*a* (from boundaries 84 to 86).

The exterior face 21 may also comprise one or more feet 82 to protect the garment bag from wear and tear. The feet 82 are preferably located at or adjacent to the first 25 and second 26 primary edges (FIG. 3), such as at or adjacent to the corners of middle primary panel 21*a*.

The primary panel 2 may contain one or more compartments for storing items (FIG. 3). Such compartments on the primary panel 2 may be located on the exterior face 21, the interior face 22 or both the exterior face 21 and the interior face 22. Such compartments are constructed to be reversibly opened and closed through the use of closure elements such as, but not limited to, zippers, snaps and the like. In a particular embodiment, such compartments are located only on the exterior face 21.

In a particular embodiment, an exemplary compartment is an organizer compartment 122 designed for storing important items that may be required to be accessed by a user. The organizer compartment 122 may contain one or more of the following elements (generally designated 123): a key ring for keys, a pocket for storing a phone or other mobile device, a pocket for storing a tablet, pockets for pens, pencils and the like, mesh pockets for jewelry and small items and a larger pocket (commonly referred to as a slash pocket) for storing larger items such as papers and documents. The organizer compartment 122 comprises a first reversibly sealable opening 126*a* on the top edge 124*a* of the compartment 122 (in a preferred embodiment a zipper). In a further embodiment, the first reversibly sealable opening 126*a* contains two closure mechanisms allowing the first reversibly sealable opening 126*a* to be opened and/or closed from either end of the first reversible sealable opening 126*a*. The organizer pocket 122 is preferably located on the exterior face 21 of the primary panel 2. (FIG. 3).

In one embodiment, the organizer compartment 122 further comprises a second reversibly sealable opening 126*b* on the bottom edge 124*b* of the compartment 122 and the interior of the compartment 122 comprises a divider 125 which is secured to the exterior face 21 along the bottom and side edges of the divider to define compartment 122*a* on one side of the divider 125 and a pocket 122*b* on the other. When the first 126*a* and second 126*b* reversibly sealable openings are each open, the pocket 122*b* can receive an extension (such as, for example, a handle) of a wheeled luggage component, which extends through the pocket and secures the garment bag 1 to the wheeled luggage component for easy transport. When the first reversibly sealable opening 126*a* contains two closure mechanisms, the first reversibly sealable opening 126*a* may be closed from opposite ends to create a tight fit around the extension of the wheeled luggage component and aid in preventing the garment bag 1 from rotating around the extension. In such a configuration, the compartment 122 is still capable of retaining any items stored therein due to the presence of the divider 125. When the second reversibly sealable opening 126*b* is closed, the pocket 122*b* can also be used to store items if desired. In one embodiment, the reversibly sealable openings 126*a* and 126*b* are secured using a zipper (although other means may be used as described herein) (FIG. 3).

Figure 4A:
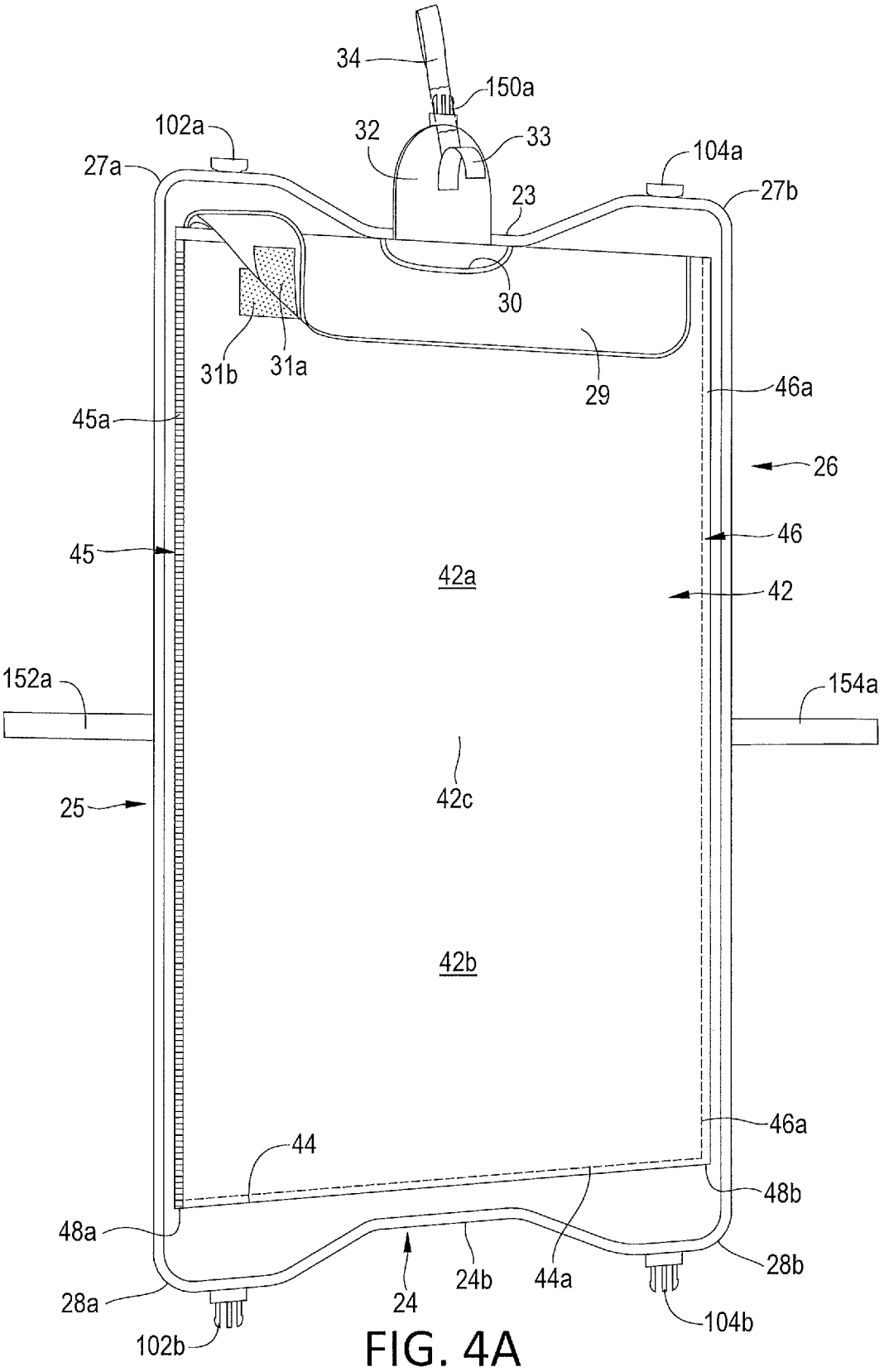
FIG. 4A shows a perspective view of an exemplary embodiment of a garment bag of the present disclosure, illustrating one embodiment of securing the exterior panel and the interior panel.

In one embodiment, the interior panel 4 comprises an inner side 41, an outer side 42, first 43 and second 44 interior ends and first 45 and second 46 interior edges (FIG. 4A). In one embodiment, the first 43 and second 44 interior ends and the first 45 and second 46 interior edges form a pair of interior upper corners 47*a* and 47*b* and a pair of interior lower corners 48*a* and 48*b* such that the interior panel 4 has a generally rectangular shape. The outer side 42 of the interior panel 4 can be considered to have a top portion 42*a* and a bottom portion 42*b* separated, divided by line 42*c* along the middle of outer side 42 (FIGS. 2A and 4A).The interior panel 4 may further comprise additional elements as described herein. For example, the interior panel 4 may further comprise a first and/or second portion of one or more interior mating assemblies, preferably located on the outer side 42 of the interior panel 4 (FIG. 4A). When the interior panel comprises the first or second portion of one or more interior mating assemblies, the first or second portion of the one or more interior mating assemblies are positioned to interact with the first or second portion of one or more interior mating assemblies 31*a*, 31*b* on the protective flap 29 as described above.

The interior panel may contain one or more compartments 56 for storing items (FIG. 2A). Such compartments 56 on the interior panel may be located on the inner side 41, the outer side 42 or both the outer side 42 and inner side 41. Such compartments 56 are constructed to be reversibly opened and closed through the use of closure elements 56*a* such as, but not limited to, zippers, snaps and the like. In a particular embodiment, such compartments 56 are located only on the outer side 42 (FIG. 2A).

The primary 2 and interior 4 panels are secured to one another such that the interior face 22 of the primary panel 2 and inner side 41 of the interior panel 4 are in a facing relationship (see for example, FIG. 4A). In one embodiment, the interior panel 4 is permanently secured to the primary panel 2 in at least one point and optionally reversibly secured to the primary panel 2 in at least one other point. In another embodiment, the interior panel 4 is permanently secured to the primary panel 2 in at least one point and optionally reversibly secured to the primary panel 2 in at least two points. In a particular embodiment, the interior panel 4 is permanently secured to the primary panel 2 at or adjacent to one of primary edges 25 or 26 along at least a portion of one of interior edges 45 or 46 (preferably along a major portion of the length of the interior edges 45 or 46), and reversible secured to the primary panel 2 at or adjacent to the other of primary edges 25 or 26 along at least a portion of the other of interior edges 45 or 46 (preferably along a major portion of the length of the interior edges 45 or 46). In the foregoing, the interior panel 4 may be permanently secured or reversible secured to the primary panel 2 at or adjacent to the second primary end 24 along at least a portion of the second interior end 44 (preferably along a major portion of the length of the second interior end 44).

In a particular embodiment, the second interior end 44 of the interior panel 4 is permanently secured to the interior face 22 of the primary panel 2 at or adjacent to the second primary end 24 along at least a portion of the length of the second interior end 44; indicated by 44*a* (preferably along a major portion of the length of the second interior end 44), the second interior edge 46 is permanently secured to the interior face 22 of the primary panel 2 at or adjacent to second primary edge 26 along at least a portion of the length of the second interior edge 46, indicated by 46*a* (preferably along a major portion of the length of the second interior edge 46) and the first interior edge 45 is reversibly secured to the interior face 22 of the primary panel 2 at or adjacent to first primary edge 25 along at least a portion of the length of the first interior edge 45, indicated by 45*a* (preferably along a major portion of the length of the first interior edge 45) (FIG. 4A).

In another particular embodiment, the second interior end 44 of the interior panel 4 is permanently secured to the interior face 22 of the primary panel 2 at or adjacent to the second primary end 24 along at least a portion of the length of the second interior end 44, indicated by 44*a* (preferably along a major portion of the length of the second interior end 44) and the first 45 and second 46 interior edges are reversibly secured to the primary panel 2 at or adjacent to first 25 and second 26 primary edges along at least a portion of the length of the first 45 and second 46 interior edges indicated by 45*a* and 46*a* (preferably along a major portion of the length of the first 45 and second 46 interior edges) (FIG. 4B) Such a configuration allows simple access to the first interior space 6 in order to place hanging garments.

In a particular embodiment, the second interior end 44 of the interior panel 4 is permanently secured to the interior face 22 of the primary panel 2 at or adjacent to the second primary end 24 along at least a portion of the length of the second interior end 44, indicated by 44*a* (preferably along a major portion of the length of the second interior end 44), the second interior edge 46 is permanently secured to the interior face 22 of the primary panel 2 at or adjacent to second primary edge 26 along at least a portion of the length of the second interior edge 46, indicated by 46*a* (preferably along a major portion of the length of the second interior edge 46) and the first interior edge 45 is permanently secured to the interior face 22 of the primary panel 2 at or adjacent to first primary edge 25 along at least a portion of the length of the first interior edge 45, indicated by 45*a* (preferably along a major portion of the length of the first interior edge 45). In this embodiment, the reversibly sealable opening 8 is located on the interior panel 4.

Figure 4B:
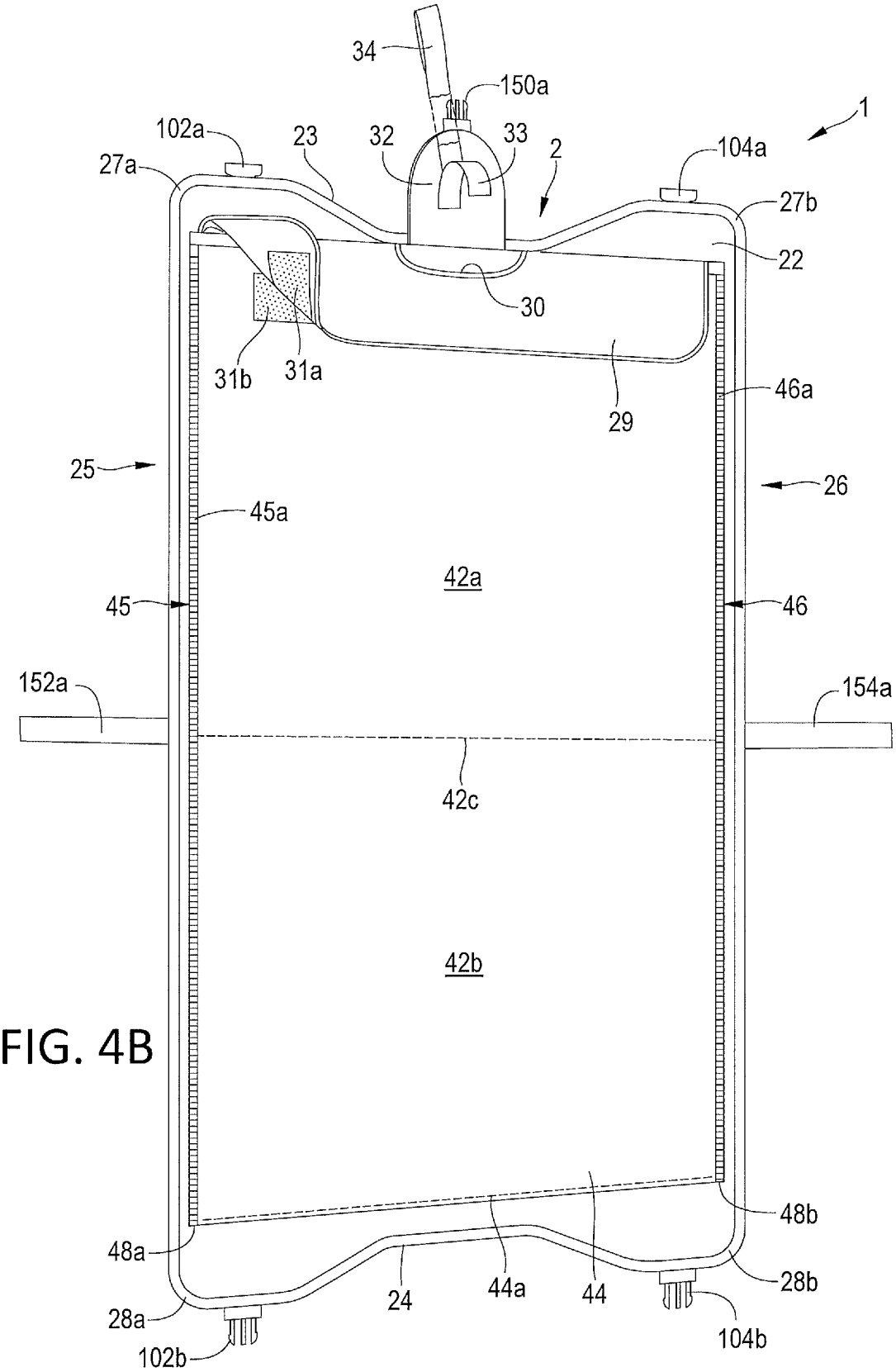
FIG. 4B shows a perspective view of an exemplary embodiment of a garment bag of the present disclosure, illustrating an alternate embodiment of securing the exterior panel and the interior panel.

In the foregoing embodiments, the first interior end 43 of the interior panel may be reversible secured to the protective flap 29 as described herein, with the outer side 42 comprising a second portion 31*b* of the interior mating assembly (for example, located at or adjacent to the first interior end 43) (FIGS. 2B, 4A and 4B). In one embodiment, the interior mating assembly is a hook and loop fastener Further, in the foregoing embodiments, the edges and/or ends which are permanently secured may be permanently secured using stitching (for example, indicated by 44*a* and 46*a* of FIG. 4A), although other methods may also be used as described herein, and edges which are reversibly secured may be reversibly secured using a zipper (for example, indicated by 45*a* of FIG. 4A), although other methods may also be used as described herein).

In certain embodiments, the interior panel 4 further comprises an extension pocket 49 secured to the interior panel 4 or the interior panel 4 and the primary panel 2 (FIGS. 5A to 5D). In one embodiment, the extension pocket comprises a first face 50*a* and a second face 50*b*. The first face 50*a* is joined to the interior panel 4 at or adjacent to second interior end 44 at first end 51*a* (preferably along a major portion of the length of the first end 51*a*) and to the second face 50*b* at the opposite end 51*b* (preferably along a major portion of the length of the end 51*b*). The end 51*c* of the second face 50*b* may be joined to the interior face 22 of the primary panel at or adjacent to the second primary end 24 (preferably along a major portion of the length of the second primary end 24) or to the inner side 41 of the interior panel 4 (preferably at the corners 51*d* of second face 50*b*) so that the extension pocket is formed as described more fully in FIGS. 5B to 5D. The side edges 50*e* of the first 50*a* and second 50*b* face may optionally be secured to one another as well (either at discrete points along sides edges 50*e* or along a major portion of the length of side edges 50*e*). Alternatively, the end 51*c* of the second face 50*b* may not be secured to any portion of the primary 2 or interior 4 panels and the side edges 50*e* of the first 50*a* and second 50*b* face secured to one another (preferably along a major portion of the length of side edges 50*e*). The purpose of the extension pocket 49 is to further expand the first interior space 6 (for example to accommodate articles, such as clothing, that are of extended length, such as for example, dresses and long coats). In one embodiment, the extension pocket is secured (preferably permanently secured) to the interior panel 4 and optionally to the primary panel 2.

Figure 5A:
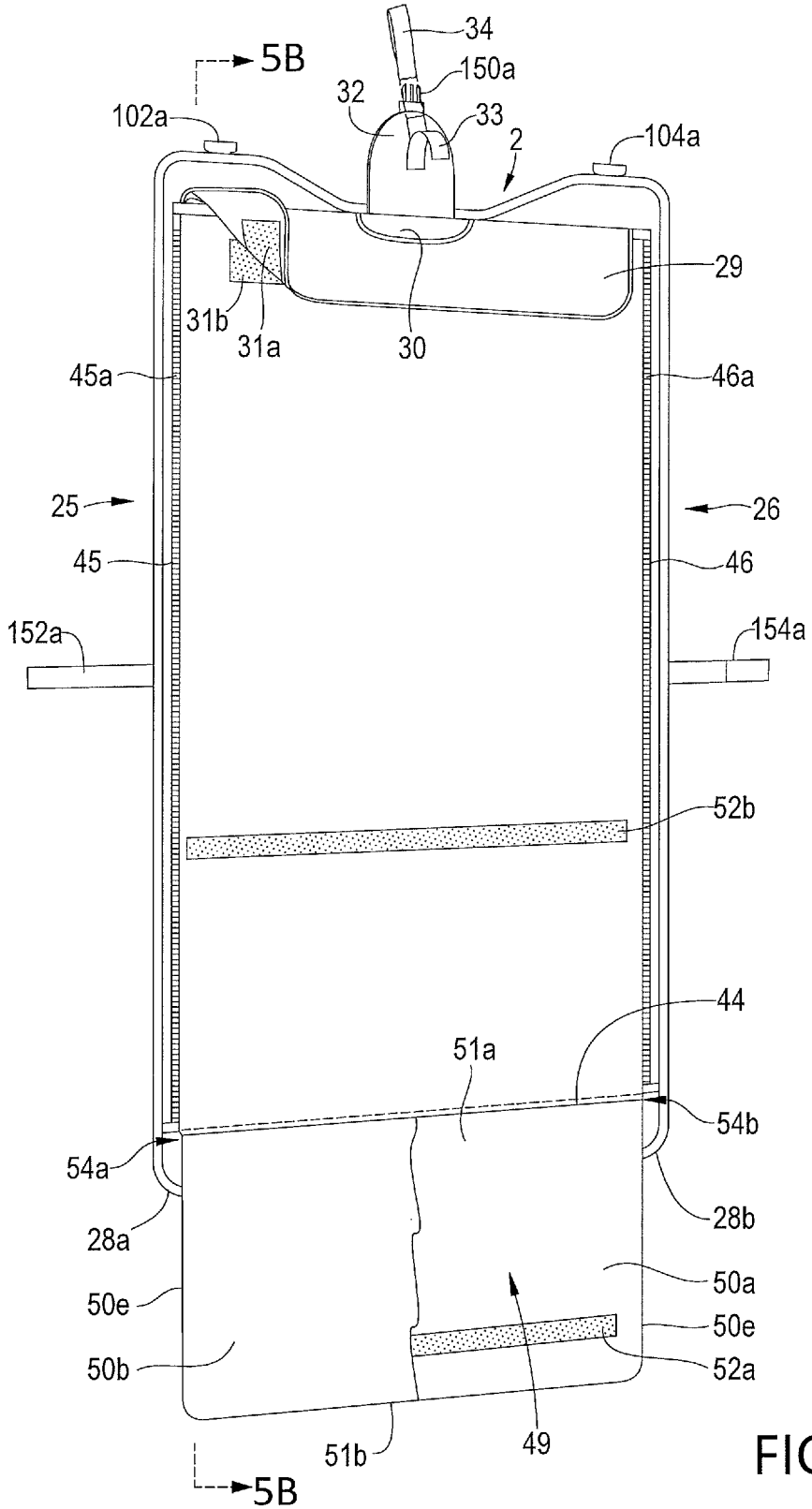
FIG. 5A shows a perspective view of an exemplary embodiment of a garment bag of the present disclosure, illustrating an extension pocket.
Figure 5B:
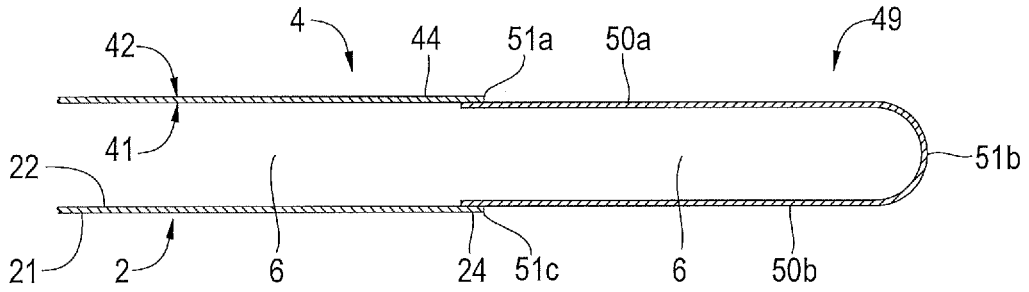
FIG. 5B shows a cutaway side view along line C-C of FIG. 5A showing one embodiment of how the extension pocket is secured to the garment bag.

In one embodiment, the extension pocket 49 comprises a first face 50*a* and a second face 50*b*, the first face 50*a* secured at end 51*a* to the interior panel 4 at or adjacent to the second interior end 44 (preferably along a major portion of the length of the second interior end 44) and at end 51*b* to one end of the second face 50*b*, with the opposite end 51*c* of the second face 50*b* secured to the primary panel 2 at or adjacent to the second primary end 24 (preferably along a major portion of the length of the second primary end 24) (FIG. 5B). The side edges 50*e* of the first 50*a* and second 50*b* face may optionally be secured to one another as well (either at discrete points along sides edges 50*e* or along a major portion of the length of side edges 50*e*) (FIG. 5A).

Figure 5C:
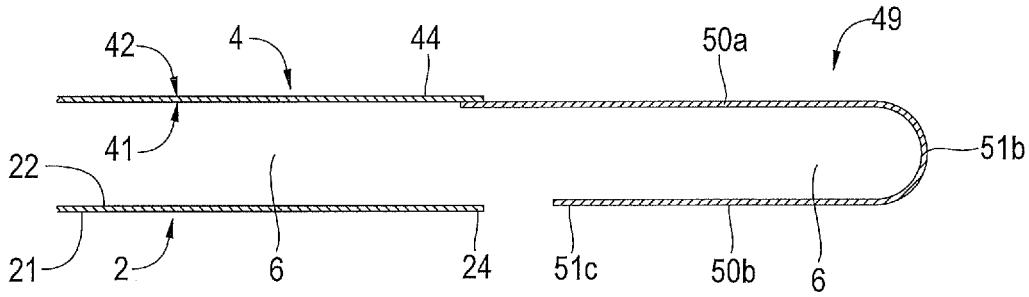
FIG. 5C shows a cutaway side view along line C-C of FIG. 5A showing another embodiment of how the extension pocket is secured to the garment bag.

In another embodiment, the extension pocket 49 comprises a first face 50*a* and a second face 50*b*, the first face 50*a* secured at end 51*a* to the interior panel 4 at or adjacent to the second interior end 44 (preferably along a major portion of the length of the second interior end 44) and at end 51*b* to one end of the second face 50*b*, with the side edges 50*e* of the first 50*a* and second 50*b* face being secured to one another along at least a portion of their length (either at discrete points along sides edges 50*e* or along a major portion of the length of side edges 50*e*). In this embodiment, the extension pocket is not secured to the primary panel 2 (FIG. 5C).

Figure 5D:
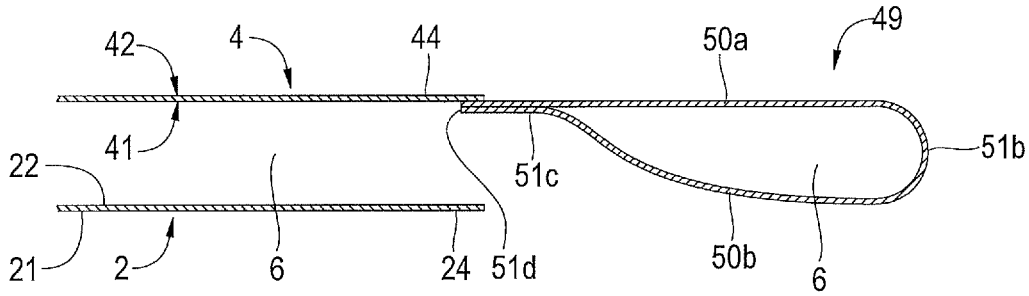
FIG. 5D shows a cutaway side view along line C-C of FIG. 5A showing yet another embodiment of how the extension pocket is secured to the garment bag.

In another embodiment, the extension pocket 49 comprises a first face 50*a* and a second face 50*b*, the first face 50*a* secured at end 51*a* to the interior panel 4 at or adjacent to the second interior end 44 (preferably along a major portion of the length of the second interior end 44) and at end 51*b* to one end of the second face 50*b*, with the opposite end 51*c* of the second face 50*b* secured to inner side 41 of the interior panel 4 (preferably at the corners 51*d* of second face 50*b*) so that the extended first interior space is easily accessible. The side edges 50*e* of the first 50*a* and second 50*b* face may optionally be secured to one another as well (either at discrete points alongside edges 50*e* or along a major portion of the length of side edges 50*c*) (FIG. 5D).

Regardless of how the extension pocket 49 is secured to the garment bag 1, the length of the extension pocket 49 is such that when secured to the garment bag 1, the length of the extension pocket 49 extends beyond the second primary end 24 of the primary panel 2. When the extension pocket 49 is present, the first interior space 6 is formed by the primary panel 2, the interior panel 4 and the extension pocket 49. Because the extension pocket 49 extends beyond the second primary end 24, the extension pocket 49 is folded back onto the outer side 42 of the interior panel 4. To aid in securing the extension pocket 49 to the interior panel 4, the extension pocket 49 may further comprise a first portion 52*a* of a second interior mating assembly (for example, at or adjacent to the end 51*b* of the first face 50*a*) and the outer side 42 of the interior panel 4 may further comprise a second portion 52*b* of the second interior mating assembly located at an appropriate distance from the second interior end 44 such that the extension pocket does not extend beyond the second primary end 24 when the extension pocket is folded over the interior face 4. In one embodiment, the second interior mating assembly is a hook and loop fastener (although any mating assembly described herein may be used).

In a particular embodiment when the extension pocket 49 is present, the extension pocket 49 comprises a first face 50*a* and a second face 50*b*, the first face 50*a* secured at end 51*a* to the interior panel 4 at or adjacent to the second interior end 44 (preferably along a major portion of the length of the second interior end 44) and at end 51*b* to one end of the second face 50*b*, with the opposite end 51*c* of the second face 50*b* secured to the primary panel 2 at or adjacent to the second primary end 24 (preferably along a major portion of the length of the second primary end 24). The side edges 50*e* of the first 50*a* and second 50*b* face may optionally be secured to one another as well (either at discrete points along sides edges 50*e* or along a major portion of the length of side edges 50*e*). In such an embodiment, the interior panel 4 is permanently secured to the primary panel 2 in at least one point and reversibly secured to the primary panel 2 in at least one other point (as described in FIGS. 4A and B). In one embodiment, the primary panel 2 is permanently secured to the interior panel 4 adjacent to primary lower corners 28*a* and 28*b* (such as at points 54*a* and 54*b*) and the first 45 and second 46 interior edges are reversibly secured to the primary panel 2 at or adjacent to first 25 and second 26 primary edges along at least a portion of the length of the first 45 and second 46 interior edges indicated by 45*a* and 46*a* (preferably along a major portion of the length of the first 45 and second 46 interior edges) (FIG. 5A). In this embodiment, the interior panel 4 is not secured to the primary panel 2 at the second interior end 44 along a major portion of the length of second interior end 44 so that the extension pocket can be accessed In certain embodiments, the width of the primary panel 2 (measured from the outer edges of the first 25 and second 26 primary edges) is greater than the width of the interior panel 4 (measured from the outer edges of the first 45 and second 46 interior edges). In certain embodiments, the length of the primary panel 2 (as measured from the outer edge of the first 23 and second 24 primary ends) is greater than the length of the interior panel 4 (as measured from the outer edge of the first 43 and second 44 interior ends). In certain embodiments, the length of the primary panel 2 (as measured from the outer edge of the first 23 and second 24 primary ends) is less than the length of the interior panel 4 combined with the extension pocket 49 (as measured from the outer edge of the first interior end 43 to the point where the first face 50*a* and second face 50*b* of the extension pocket 49 join one another).

General Purpose Bag

The general purpose bag 200 may be of any shape known in the art (FIGS. 6A to 6D). In one embodiment, the general purpose bag 200 has a generally rectangular shape. In one embodiment, the general purpose bag 200 has a length that is greater than its width. In a particular embodiment, the general purpose bag has a length from between 15 and 26 inches, a width of between 5 and 15 inches and a height from between 7 and 14.5 inches. In a particular embodiment, the general purpose bag has a length from between 19 and 22 inches and a width of between 7 and 11 inches and a height from between 9 and 10.5 inches. In the above descriptions, the length is measured form the outer edge of the first 202 and second 204 end panels and the width is measured from the outer edges of the first 210 and second 212 side panels (as such terms are described herein). In a particular embodiment, the general purpose bag 200 has a length that is substantially the same as the width of the garment bag 1. In another particular embodiment, the general purpose bag 200 has a width that is no less than 80% the width of the garment bag.

The general purpose bag may be manufactured from any material known in the art. In one embodiment, the general purpose bag 200 is manufactured from a cloth fabric or a polymer material. In one embodiment, the general purpose bag 200 may be manufactured from two or more materials. For example, the exterior of the various panels may be manufactured from a polymer material (such as, for example, nylon) and the interior of the various panels may be manufactured from a different polymer material (such as, for example, polyester). In addition, the bottom panel 208 of the general purpose bag 200 may be manufactured from a more durable polymer (such as, for example, polypropylene). The material from which the general purpose bag 200 is manufactured may also be treated to be stain resistant (such as, for example, with Teflon), water resistant and/or fire retardant. Furthermore, the general purpose bag 200 may comprise one or more design elements 230 for aesthetic and functional appeal. In certain embodiments, the design element 230 is a part of the material from which the general purpose bag 200 is manufactured. For example, the aesthetic element 230 may aid in identification of the general purpose bag 200 at a distance or when retrieving the general purpose bag 200 from a storage area. In one embodiment, the design element 230 is a geometric design, such as one or more stripes and is located on one or more of the first 210 or second 212 side panels and/or the first 202 or second 204 end panels.

Figure 6A:
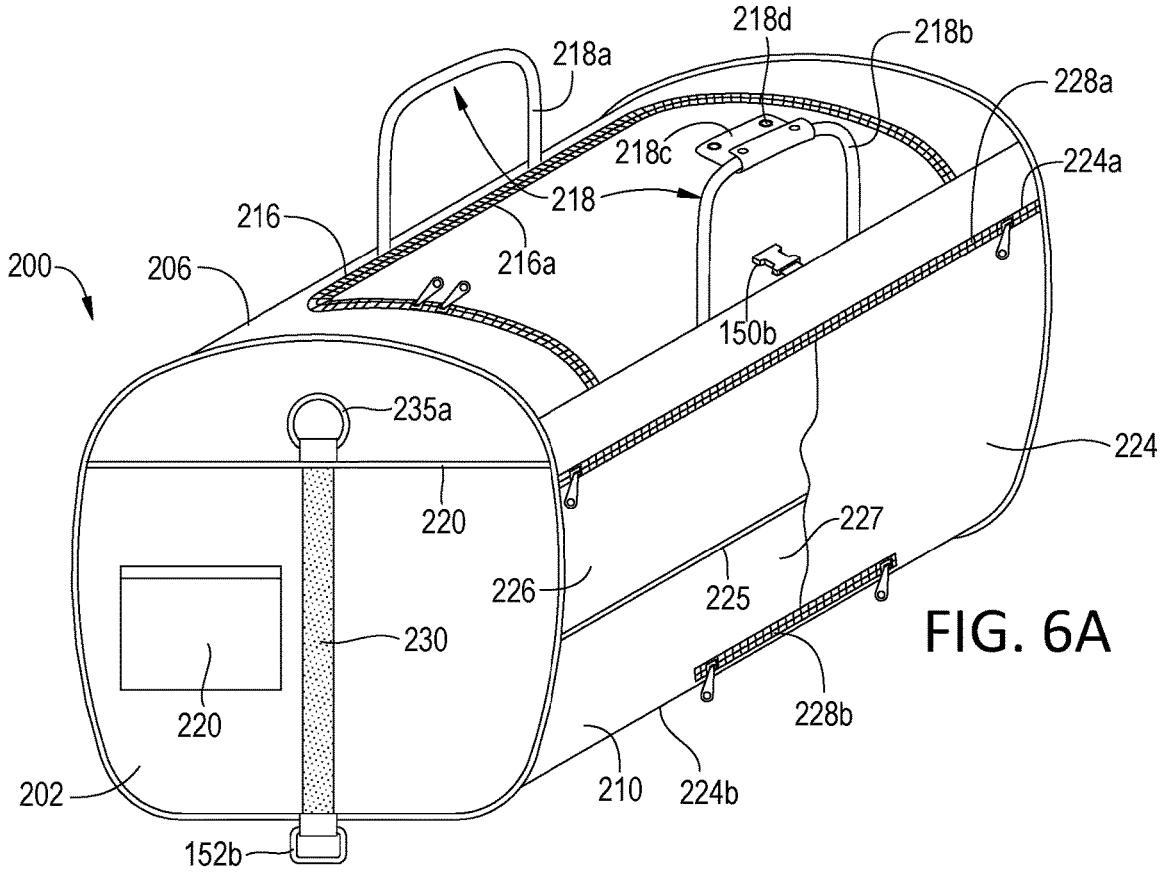
FIG. 6A shows a perspective view of an exemplary embodiment of a general purpose bag of the present disclosure.
Figure 6B:
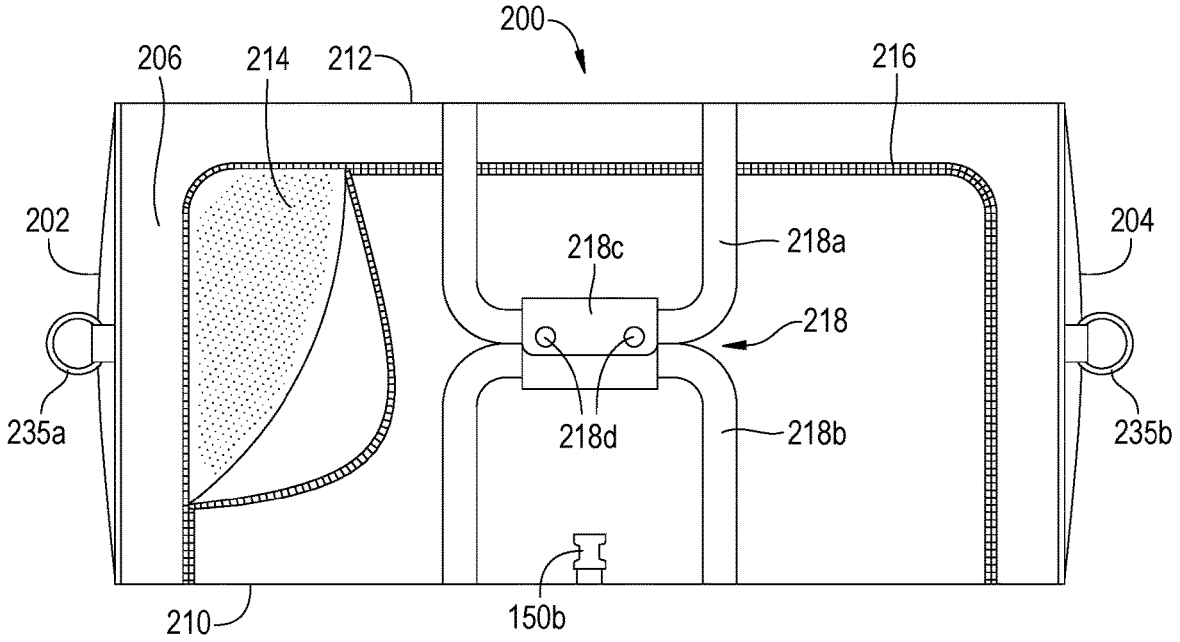
FIG. 6B shows a top view of an exemplary embodiment of a general purpose bag of the present disclosure.
Figure 6C:
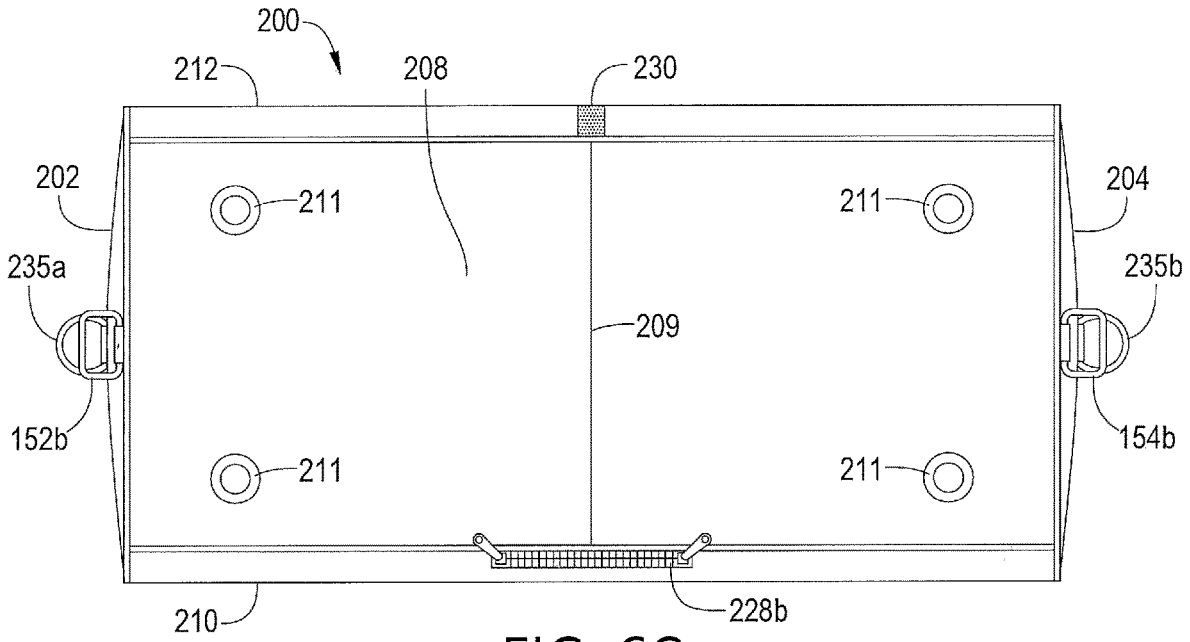
FIG. 6C shows a bottom view of an exemplary embodiment of a general purpose bag of the present disclosure.

The general purpose bag 200 generally comprises a first end panel 202, a second end panel 204, a top panel 206, a bottom panel 208, a first side panel 210 and a second side panel 212, the first and second side panels 210 and 212 joining the first end panel 202, second end panel 204, top 206 and bottom 208 panels to define a second interior space 214, at least one reversibly sealable opening 216 to access the second interior space, a portion of at least one combination mating assembly (for example 150*b*) secured to the garment bag, and a carrying assembly 218 secured to the general purpose bag (for example, on top panel 206 (FIG. 6A). In a particular embodiment, the bottom panel comprises a break point 209, preferably extending at least partially (in one embodiment completely) from the first 210 to the second 212 side panel and substantially in the middle (between first and second end 210 and 212) of bottom panel 208, to allow for folding of the general purpose bag 200 when not in use. The bottom panel may also comprise one or more feet 211 to protect the general purpose bag from wear and tear. The feet are preferably located at or adjacent to the corners of the bottom panel 208 (FIG. 6C).

In certain embodiments, the general purpose bag further comprises a plurality of receivers 235*a*, 235*b* for a strap, such as a shoulder strap or the like, to enable the general purpose bag 200 to be carried by a user (for example, when used alone) (FIG. 6A). In one embodiment, the receivers 235*a*, 235*b* are a ring. A shoulder strap may also be provided. The receivers 235*a*, 235*b* may be placed at any location desired, however, in one embodiment a first receiver 235*a* is positioned on or adjacent to a midpoint of first end panel 202 and a second receiver 235*b* is placed on or adjacent to a midpoint of second end panel 204 (FIG. 6B).

The general purpose bag 200 may contain one or more compartments 220 for storing items. Such compartments 220 may be located on any portion of the garment bag 200. For example, the compartments may be located on the exterior portions of the garment bag 200 and in the second interior space 214. For example, compartments 220 may be located on the exterior of the first side panel 210, the interior of the first side panel 210 and on the interior of the second side panel 212. Such compartments 220 are constructed to be reversibly opened and closed through the use of closure elements 220*b* such as, but not limited to, zippers, snaps and the like (FIG. 6A).

The carrying assembly 218 allows for one method of carrying the garment bag, in both the combination with the garment bag 1 as well as when used individually. The carrying assembly 218 is preferably located in a middle portion of top panel 216 at or adjacent to midpoint 216*a*. The carrying assembly may take on a number of fowls as is known in the art. In a preferred embodiment, the carrying assembly 218 is located at a midpoint 216*a* of the top portion 216. The carrying assembly 218 is illustrated in FIGS. 6A and 6B. In this embodiment, the carrying assembly comprises a first portion 218*a* and a second portion 218*b*, with portion 218*a* located on or adjacent to a side edge of the top panel 216 and portion 218*b* located on or adjacent to the other side edge of top panel 216. Portions 218*a* and 218*b* are conveniently straps of material secured (preferably permanently secured) to the top portion 216 at the locations described. Portions 218*a* and *b* may be secured to one another. In one embodiment, one of portions 218*a* or 218*b* further comprise a securing portion 218*c* which functions to secure the portions 218*a* and 218*b* to one another. Securing portion 218*c* may further comprises first and second 218*d* portions of a mating assembly to reversibly secure the securing portion 218*c* around portions 218*a* and 218*b*. The carrying assembly 218 may take on any form known in the art with the embodiments described above being exemplary.

Figure 8A:
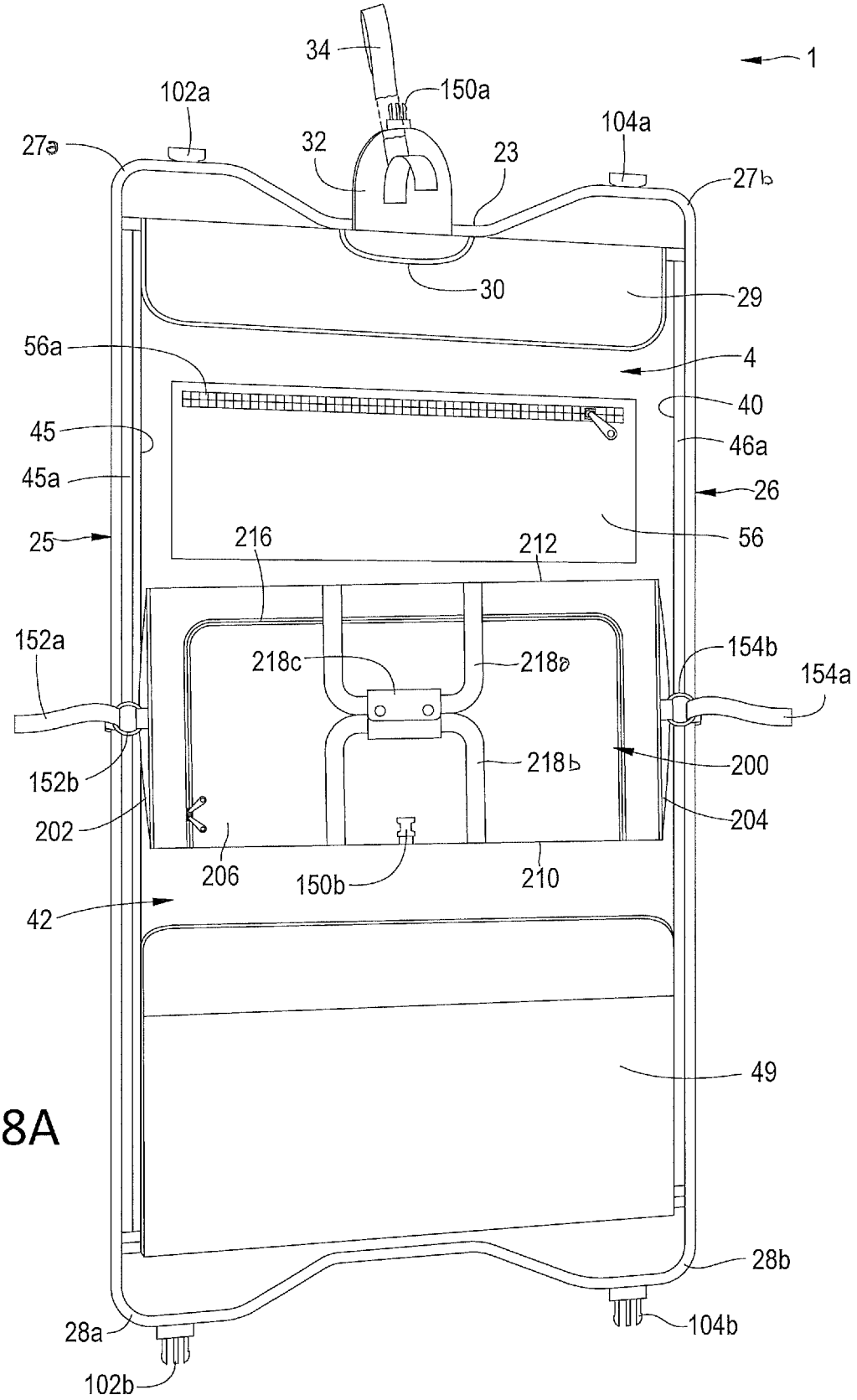
FIG. 8A shows an overhead view of the garment bag and general purpose bag in preparation for forming the combination of the garment bag and the general purpose bag.
Figure 8B:
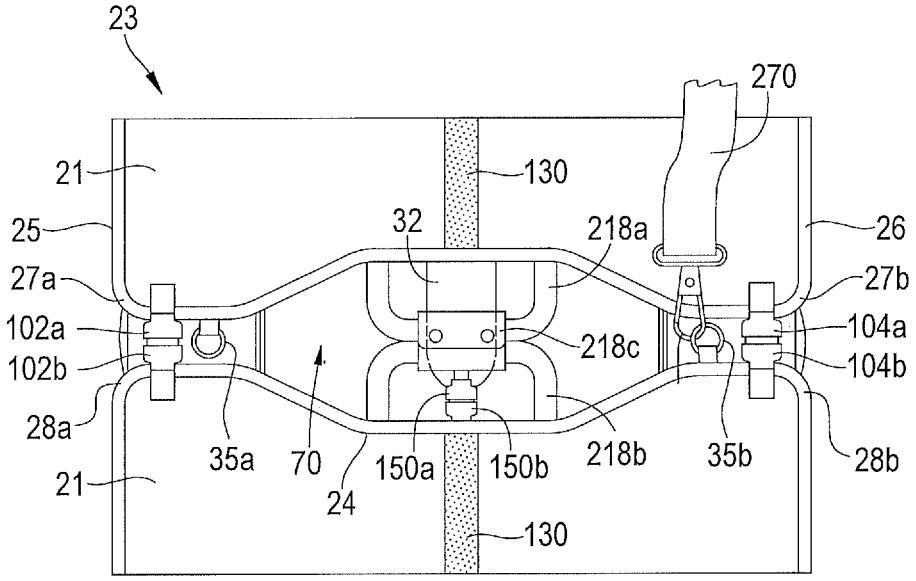
FIG. 8B shows an overhead view of one embodiment of the garment bag/general purpose bag combination, illustrating the points of contact between the garment bag and the general purpose bag.
Figure 8C:
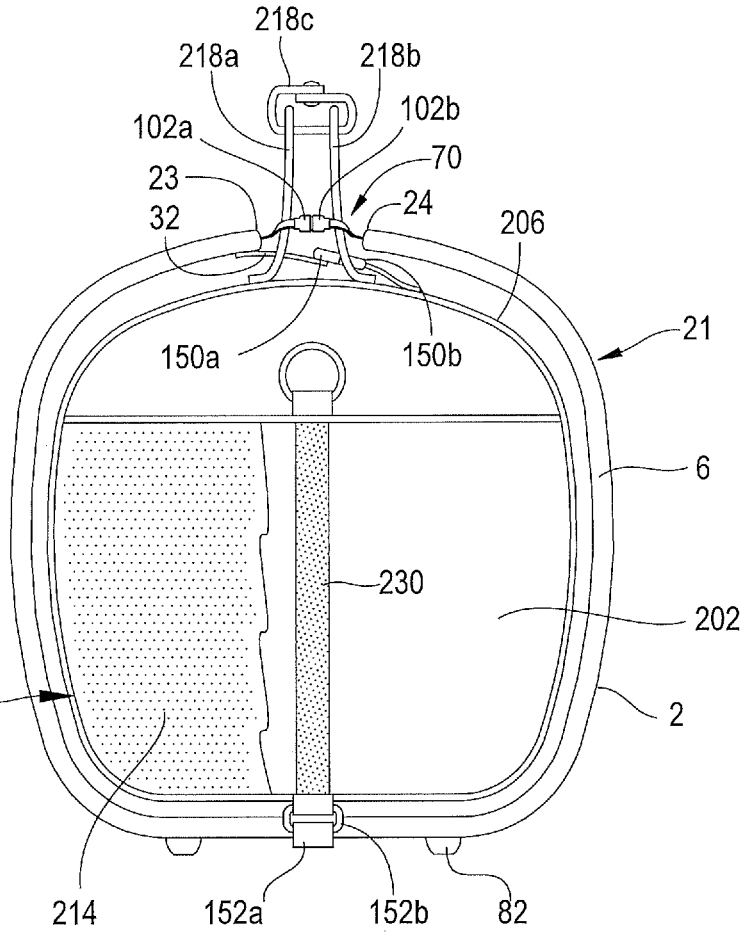
FIG. 8C shows a side view of one embodiment of the garment bag/general purpose bag combination, illustrating the points of contact between the garment bag and the general purpose bag.

As discussed herein, in one embodiment, the carrying assembly 218, in whatever form, is accessible through gap 70 formed by the first 23 and second 24 primary ends of the garment bag 1 (FIGS. 8B to 8C).

In a particular embodiment, the general purpose bag comprises an organizer compartment 222 designed for storing important items that may be required to be accessed by a user. The organizer compartment 222 may contain one or more of the following elements (generally designated 223): a key ring for keys, a pocket for storing a phone or other mobile device, a pocket for storing a tablet, pockets for pens, pencils and the like, mesh pockets for storing jewelry and other small items and a larger pocket (commonly referred to as a slash pocket) for storing larger items such as papers and documents. The organizer compartment 222 may further comprise a first reversibly sealable opening 222*a* on the top edge of the compartment 222 (in a preferred embodiment a zipper). The organizer pocket is preferably located on the exterior of side panel 210 or 212 (FIG. 6A).

Figure 6D:
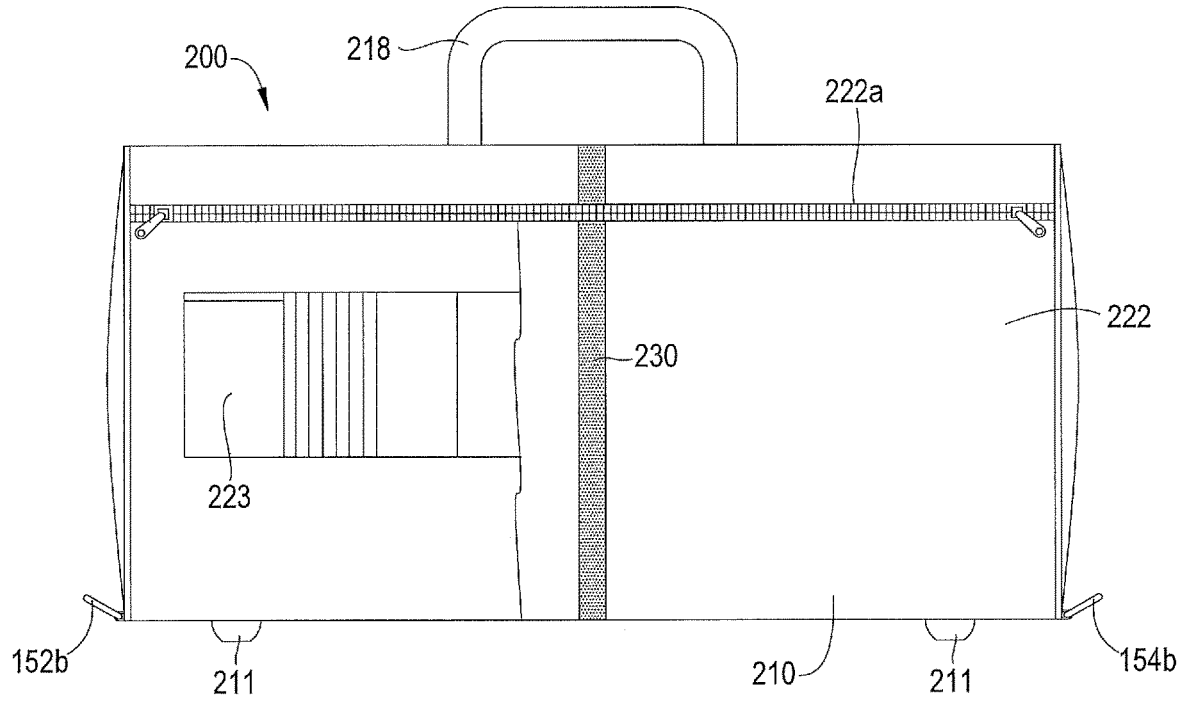
FIG. 6D shows a side view of an exemplary embodiment of a general purpose bag of the present disclosure.

In another particular embodiment, the general purpose bag comprises a dual purpose compartment 224 (FIG. 6D). The dual purpose compartment 224 is preferably placed on the exterior of side panel 210 or 212 (for example, the side portion opposite the organizer compartment 222 if present). The dual purpose compartment comprises a first reversibly sealable opening 228*a* on the top edge 224*a* of the compartment 224 and a second reversibly sealable opening 228*b* on the bottom edge 224*b* of the compartment 224. The interior of the compartment 224 comprises a divider 225 which is secured to the side panel along the bottom and side edges of the divider to define a storage area 226 on one side of the divider 225 and a pocket 227 on the other. When the first 228*a* and second 228*b* reversibly sealable openings are each open, the pocket 227 can receive an extension (such as, for example, a handle) of a wheeled luggage component, which enters through opening 228*b* and exits through opening 228*a*, and thereby extends through the pocket and secures the general purpose bag 200 to the wheeled luggage component for easy transport. In a further preferred embodiment, the first reversibly sealable opening 228*a* contains two closure mechanisms allowing the first reversibly sealable opening 228*a* to be opened and/or closed from either end of the first reversible sealable opening 228*a*. When the first reversibly sealable opening 228*a* contains two closure mechanisms, the first reversibly sealable opening 228*a* may be closed from opposite ends to create a tight fit around the extension of the wheeled luggage component and aid in preventing the general purpose bag 200 from rotating around the extension.

In such a configuration, the storage area 226 is still capable of retaining any items stored therein due to the presence of the divider 225. When the second reversibly sealable opening 228*b* is closed, the pocket 227 can also be used to store items if desired. In one embodiment, the reversibly sealable openings are secured using a zipper (although other means may be used as described herein).

Utility Bag

The luggage combination optionally comprises a utility bag. The utility bag, when present may be used for packing desired articles (either on its own or for packing in the garment bag or general purpose bag as disclosed herein) or simply stored in the garment bag or general purpose bag. The utility bag provides several features. First, the utility bag may be used to store clothing worn during a trip in one location so that articles of clothing are not lost during travel. Second, the utility bag may be used to pack clothing worn during a trip to keep it separated from the clean clothing and packed in the garment bag or general purpose bag. Third, the utility bag may also serve as a storage device for the garment bag and general purpose bag when not in use. Fourth, the utility bag may also conveniently be used to carry items when on a trip (for example, to carry personal items during an outing), obviating the need to pack an additional bag for use during the trip.

Figure 7A:
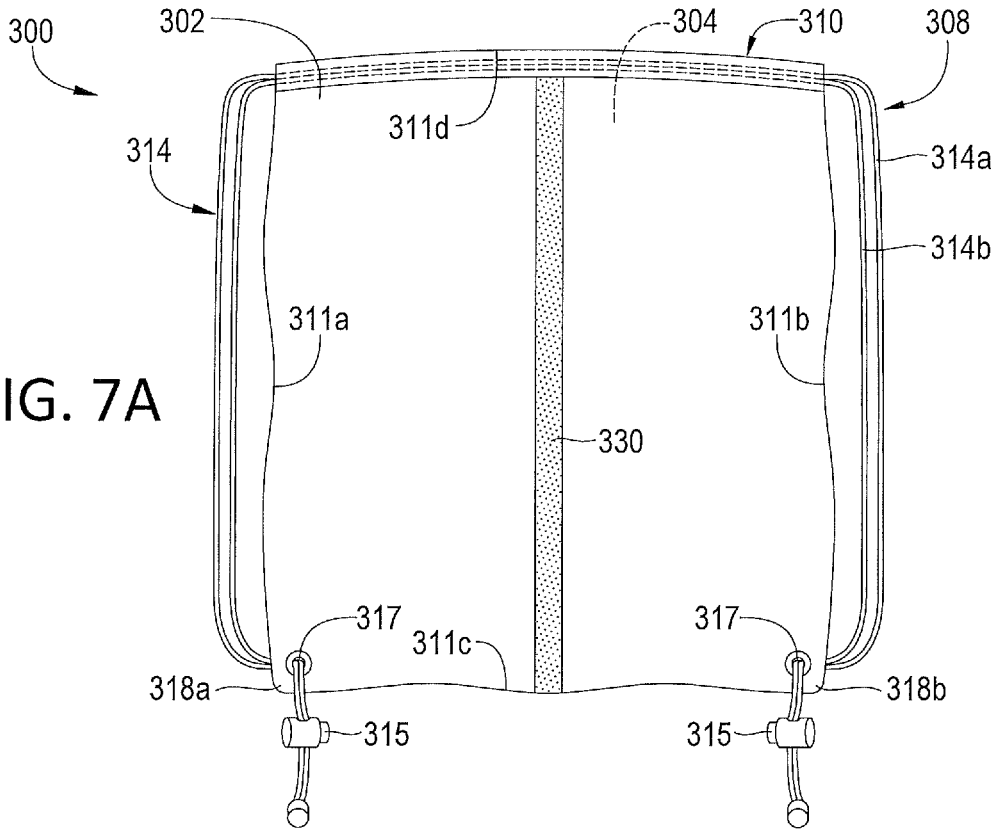
FIG. 7A shows a front view of one embodiment of the utility bag.

The utility bag may be manufactured from any material known in the art. In one embodiment, the utility bag 300 is manufactured from a cloth fabric or a polymer material. In one embodiment, the utility bag 300 may be manufactured from two or more materials. The material from which the utility bag 300 is manufactured may also be treated to be stain resistant (such as, for example, with Teflon), water resistant and/or fire retardant. Furthermore, the utility bag 300 may comprise one or more design elements 330 for aesthetic and functional appeal. In certain embodiments, the design element 330 is a part of the material from which the utility bag 300 is manufactured. For example, the design element 330 may aid in identification of the utility bag 300 at a distance or when retrieving the utility bag 300 from a storage area. In one embodiment, the design element 330 is a geometric design, such as one or more stripes and is located on the outer shell 302 (for example, one or both of the first 310 or second 312 faces) (FIG. 7A).

The utility bag 300 may take on a variety of fauns and the exact form of the utility bag 300 is not critical. Whatever the configuration, the utility bag does not have rigid shell such that the utility bag can be folded into a small space for transport. In a general embodiment, the utility bag 300 comprises an outer shell 302 defining a third interior space 304, an opening 306 for accessing the interior space and a carrying assembly 308. The opening 306 may be reversibly sealable if desired (such as through the use of a flap secured to the outer shell or thought the use of a drawstring).

Figure 7B:
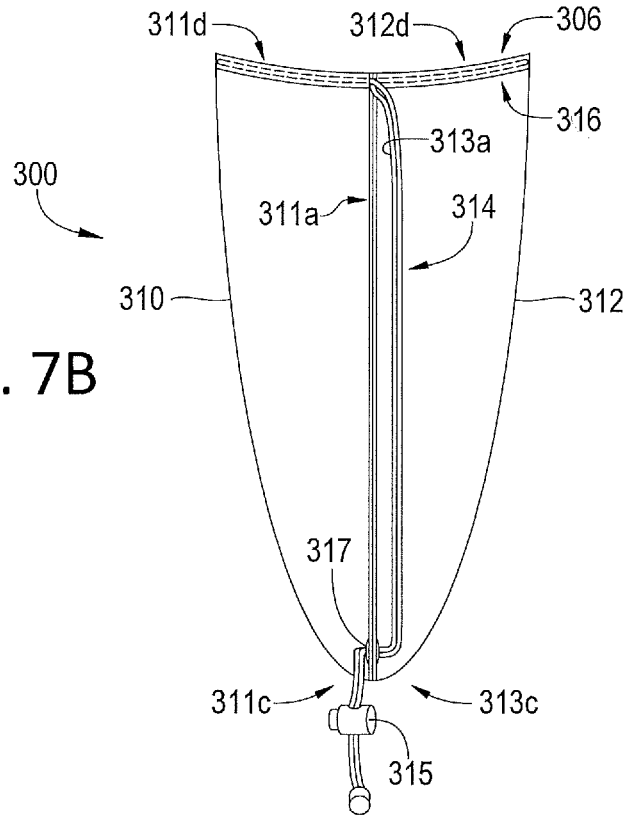
FIG. 7B shows a side view of one embodiment of the utility bag.
Figure 7C:
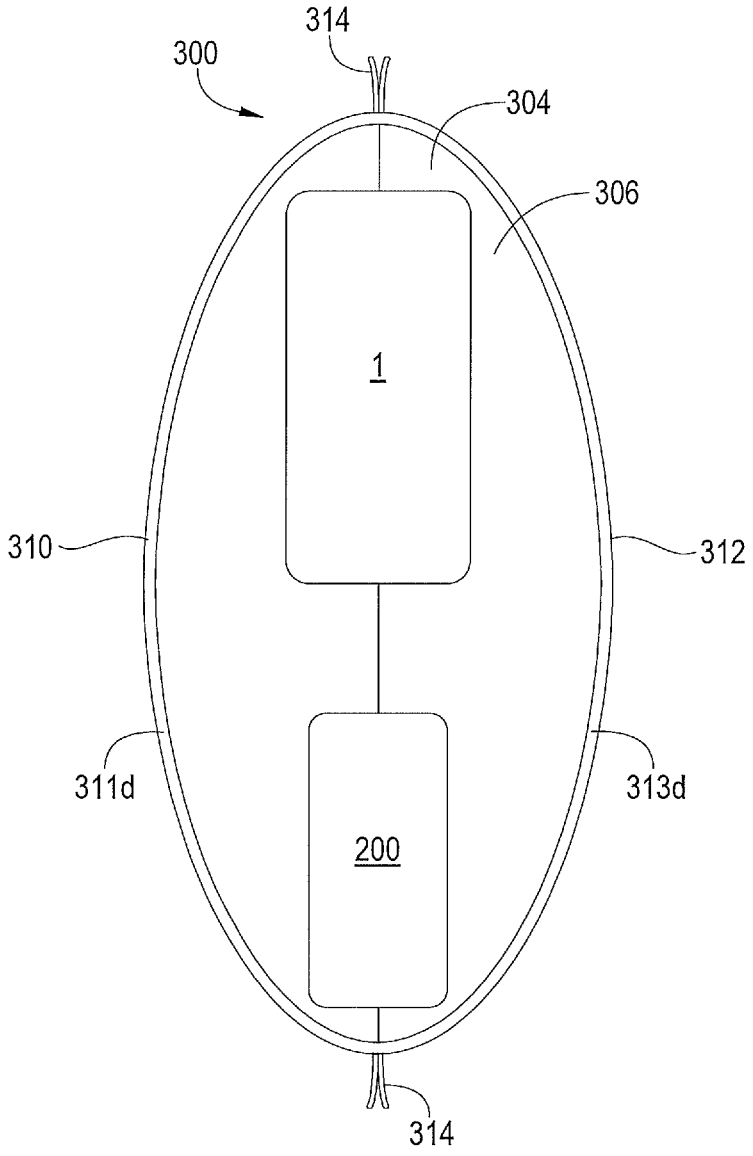
FIG. 7C shows an overhead view of one embodiment of the utility bag, illustrating the utility bag as used to store the garment bag and general purpose bag.

An illustrative embodiment of the utility bag 300 that may conveniently be used in conjunction with the garment bag and general purpose bag combination described herein is provided below for illustrative purposes (See FIGS. 7A to 7C). In a particular embodiment, the outer shell 302 has a first side 310, having side edges 311*a* and 311*b*, a bottom edge 311*c* and a top edge 311*d*, and a second side 312, having side edges 313*a* and 313*b*, a bottom edge 313*c* and a top edge 313*d*. The first side 310 and second side 312 are secured together (preferably permanently secured) alongside edges 311*a* and 313*a*, 311*b* and 313*b* and bottom edge 311*c* and 313*c*. Top edges 311*d* and 313*d* may contain a portion of the carrying assembly 308. A carrying assembly 308 is also provided and may be secured to the utility bag 300 at any location desired. For example, the carrying assembly 308 may be a pair of handle straps secured to the utility bag at or adjacent to top edges 311*d* and 313*d*. As a further example, the carrying assembly 308 may be an adjustable drawstring 314. Both straps and drawstring 314 may be included. In a particular embodiment, the carrying assembly 308 is a drawstring 314. The drawstring 314 may also be used to form a closure for the top edges 311*d* and 313*d* and at least partially close the third interior space 304. Conveniently, the drawstring 314 is contained within channels 316 preferably located on the interior of first 310 and second 312 sides) at or adjacent to the top edges 311*d* and 313*d*, the drawstring 314 exiting the channels 316 and extending down the juncture of the side edges 311*a* and 313*a* and 311*b* and 313*b* to the bottom edges 311*c* and 313*c*. The drawstring 314 is adjustable secured at or adjacent to the bottom edges 311*c* and 313*c*. Conveniently, the first 310 and second 312 face may each have an opening 317 (for example a grommet) through which the drawstring 314 passes (for example, adjacent to bottom corners 318*a* and 318*b*) with the ends of the drawstring being adjustably secured by adjustment element 315 (FIGS. 7A and 7B).

In this embodiment, the portions of the drawstring 314 extending down the juncture of the side edges 311*a* and 313*a* and 311*b* and 313, indicated as 314*a* and 314*b*, may be used to carry the utility bag (for example, like a backpack). The carrying assembly also serves to provide a closure for the utility bag 300. In an embodiment where drawstring 314 is not employed, the utility bag may comprise a pair of handle straps (not shown) secured to the utility bag at or adjacent to top edges 311*d* and 313*d* as the carrying assembly 308 and first and second portions of a mating assembly (in certain embodiments a plurality of mating assemblies) to reversibly secure the top ends 311*d* and 313*d* of the utility bag 300 (for example, a zipper or snaps) (FIG. 7C).

As discussed herein, the utility bag 300 may be used to store the garment bag 1 and/or general purpose bag 200. Conveniently, the first 23 and second 24 primary ends of garment bag 1 are folded onto the outer side of interior panel 4 and the garment bag 1 is further folded along break point 80 to reduce the size of garment bag 1 for storage. Likewise, the general purpose bag 200 can be flattened and folded along break point 209 to reduce the size of general purpose bag 200 for storage. The garment bag and general purpose bag 200 may then be placed inside third interior space 304 for convenient storage (FIG. 7C).

Placement of Mating Assemblies

As discussed herein, the garment bag is in the compact configuration when the luggage combination is formed and in use. The mating assemblies described are used to create the combination and to secure the garment bag 1 to the general purpose bag 200 and portions of the garment bag 1 to itself In particular, a the garment bag mating assembly/assemblies are used to reversibly secure a first portion of the garment bag 1 to a second portion of the garment bag 1 and the combination mating assembly/assemblies are used to reversibly secure the general purpose bag 200 to the garment bag 1.

The garment bag 1 may comprise one garment bag mating assembly or more than one garment bag mating assembly (such as two, three or four or more). In one embodiment, the garment bag comprises one or two garment bag mating assemblies, with each assembly comprising a first and second portion. The first and second portions of each garment bag mating assembly are secured (preferably permanently secured) to the garment bag in a relationship to one another such that the first and second portions may cooperatively interact with one another (FIG. 2A).

In a particular embodiment, the garment bag 1 comprises a first garment bag mating assembly 102 and a second garment bag mating assembly 104 with the first 102*a* and 104*a* and second 102*b* and 104*b* portions positioned on opposite end portions of the garment bag 1 (such as, for example, the first 23 and second 24 primary ends) (FIG. 8A). In a further particular embodiment, the garment bag 1 comprises a first garment bag mating assembly 102 and a second garment bag mating assembly 104 with the first 102*a* and 104*a* and second 102*b* and 104*b* portions at or adjacent to opposite corner portions of the garment bag 1 (such as, for example, at or adjacent to the primary upper corners 27*a* and 27*b* and the primary lower corners 28*a* and 28*b*, respectively). In a particular embodiment, the garment bag does not contain a garment bag mating assembly, or an element thereof, at a midpoint 23*a* or 24*a* on the first 23 or second 24 primary ends. In a particular embodiment, the garment bag mating assembly/assemblies are quick release buckles (which may be secured, preferably permanently secured, to the garment bag by a short strap). It is preferred, although not required, that each garment bag mating assembly be of the same type. It is preferred that the garment bag mating assembly/assemblies be positioned on the exterior face 21 of the primary panel 2 (although they may be positioned at other locations as described herein, such as on the interior face 22 as well).

Further, the garment bag and the general purpose bag each comprise a portion of one or more combination mating assemblies. As the combination mating assemblies perform the function of reversible securing the garment bag to the general purpose bag in the when used as a combination, one of the first or second portions of each combination mating assembly is positioned on the garment bag 1 and the other positioned on the general purpose bag 200.

In a preferred embodiment, the garment bag comprises a first portion 150*a* of a first combination mating assembly 150 and the general purpose bag comprises a second portion 150*b* of the first combination mating assembly 150. While the respective portions of the combination mating assembly may be positioned at any point that allows their cooperative interaction, a preferred position of the respective portions is: i) the first portion 150*a* of the first combination mating assembly 150 is positioned at or adjacent to the midpoint 23*a* of the first primary end 23 (such as on the tab 32); and ii) the second portion 150*b* of the first combination mating assembly 150 is positioned on the general purpose bag on the top panel 206 adjacent to carrying assembly 218 (FIGS. 2A,6A-C and 8A-D).

In another preferred embodiment, the garment bag comprises first portions 150*a* and 152*a* of a first 150 and a second 152 combination mating assembly and the general purpose bag comprises second portions 150*b* and 152*b* of a first 150 and a second 152 combination mating assembly. While the respective portions of the combination mating assemblies may be positioned at any point that allows their cooperative interaction, a preferred position of the respective portions is: i) the first portion 150*a* of the first combination mating assembly 150 is positioned at or adjacent to the midpoint 23*a* of the first primary end 23 (such as on the tab 32); ii) the first portion 152*a* of the second combination mating assembly is positioned at or adjacent to a midpoint of the first 25 or second 26 primary edge; iii) the second portion 150*b* of the first combination mating assembly 150 is positioned on the top panel 206 adjacent to carrying assembly 218; and iv) the second portion 152*b* of the second combination mating assembly 152 is positioned at or adjacent to a midpoint of the first 202 or second 204 end panels (FIGS. 2A, 6A-C and 8A-D).

In another preferred embodiment, the garment bag comprises first portions 150*a*, 152*a* and 154*a* of a first 150, second 152 and third 154 combination mating assembly and the general purpose bag comprises second portions 150*b*, 152*b* and 154*b* of the first 150, second 152 and third 154 combination mating assembly. While the respectively portions of the combination mating assemblies may be positioned at any point that allows their cooperative interaction, a preferred position of the respective portions is: i) the first portion 150*a* of the first combination mating assembly 150 is positioned at or adjacent to the midpoint 23*a* of the first primary end 23 (such as on the tab 32); ii) the first portion 152*a* of the second combination mating assembly 152 is positioned at or adjacent to a midpoint of the first primary edge 25; iii) the first portion 154*a* of the third combination mating assembly 154 is positioned at or adjacent to a midpoint of the second primary edge 26; iv) the second portion 150*b* of the first combination mating assembly 150 is positioned on the top panel 206 adjacent to carrying assembly 218; v) the second portion 152*b* of the second combination mating assembly 152 is positioned at or adjacent to a midpoint of the first end panel 202; and vi) the second portion 154*b* of the third combination mating assembly 154 is positioned at or adjacent to a midpoint of the second end panel 204 (FIGS. 3, 6A-C and 8A-D).

The first and second portions of each combination mating assembly are secured (preferably permanently secured) to the garment bag and general purpose bag, respectively, in a relationship to one another such that the first and second portions may cooperatively interact with one another.

In the foregoing embodiments, the first 150*a* and second 150*b* portions of the first combination mating assembly 150 are male and female portions of a quick release buckle (which may be secured, preferably permanently secured to the garment bag and general purpose bag by a short strap) and the first portions 152*a* and 154*a* of the second 152 and third 154 combination mating assemblies are a strap of hook and loop fastener capable of forming a reversibly secured loop and the second portions 152*b* and 154*b* of the second 152 and third 154 combination mating assemblies are a receiving ring. It is preferred that the various portions of the mating assemblies be positioned on the exterior face 21 of the primary panel 2 of the garment bag (although they may be positioned on the interior face 22 as well) and on the exterior panels of the general purpose bag.

In a particular embodiment, the garment bag comprises two garment bag mating assemblies 102 and 104 and three combination mating assemblies 150, 152 and 154 as shown in FIGS. 3, 6A-C and 8A-D.

Use of the Luggage Combination.

The use of the luggage combination and the operation of the mating assemblies describe above to form the compact configuration is illustrated below through an example (which is not meant to be limiting as to the use of the luggage combination or the operation of the mating assemblies to form the compact configuration). The following description refers to the elements of the garment bag in a preferred embodiment and does not require that the claimed garment bag or general purpose bag as claimed have each and every one of the features described (for example, the protecting flap is described and is not intended to convey that the garment bag comprise a protecting flap in every embodiment).

In one embodiment, a user takes the garment bag and conveniently lays the garment bag on a flat surface for packing. The user may access the first interior space by opening the at least one reversibly sealable opening (such as by unzipping) and places the desired articles of clothing and optionally other items in the first interior space. In a preferred embodiment, the garment bag has two reversibly sealable openings (see FIG. 4B at 45*a* and 46*a*). The protecting flap may be folded back over the first primary end of the garment bag and the interior panel pulled back to allow the articles of clothing to be placed on the interior face of the primary panel. If the extension pocket is need for longer articles of clothing, the extension pocket may be extended over the second primary end of the garment bag. The user may optionally place additional items in the one or more compartments, for example, the organizer compartment.

Once the user is finished packing the garment bag, the interior panel is folded back over the primary panel and the at least one reversibly sealable opening is closed. The hangers or other devices on which the articles of clothing are placed are partially inserted through the opening in the protective flap and the securing element on the tab may be used to secure the hangers of other devices. The protective flap may then be folded back over the outer side of the interior face and secured as described herein. If the extension pocket was used, it is folded over the interior panel and secured to the interior panel as described herein.

The user then packs the general purpose bag by opening the at least one reversibly sealable opening to access the second interior space. The user places desired articles (for example, clothing toiletries, shoes and the like) in the second interior space. The user may also place desired articles in one or more of the compartments on the general purpose bag. When finished, the at least one reversibly sealable opening is closed.

The used may then form the luggage combination. In one embodiment, the garment bag comprises first 102 and second 104 garment bag mating assemblies and first portions 150*a*, 152*a* and 154*a* of the first 150, second 152 and third 154 combination mating assemblies and the general purpose bag comprises second portions 150*b*, 152*b* and 154*b* of the first 150, second 152 and third 154 combination mating assemblies. The various components of the mating assemblies are located at the positions described herein (for example, in FIGS. 8A-8C). In one embodiment, a user extends the packed garment bag 1 with the outer side of the interior panel 4 facing the user. The general purpose bag 200 is placed in approximately the middle portion of the interior panel 4 such that the bottom panel 208 of the general purpose bag 200 contacts the outer side 42 of the interior panel 4. In such a position, first portions 152*a* and 154*a* of the second 152 and third 154 combination mating assemblies on the garment bag 1 and the second portions 152*b* and 154*b* of the second 152 and third 154 combination mating assemblies on the general purpose bag 200 are each in locations for cooperative interaction. The user then joins the second 152 and third 154 combination mating assemblies to at least partially secure the garment bag 1 and the general purpose bag 200 together. In a preferred embodiment, the first portions 152*a* and 154*a* of the second 152 and third 154 combination mating assemblies are a strap of hook and loop fastener and the second portions 152*b* and 154*b* of the second 152 and third 154 combination mating assemblies are receiver rings, wherein one end of the hook and loop fasteners is threaded through the receiver ring and secured to the remaining portion of the hook and loop fastener (FIG. 8A).

Once completed, the user then folds first 23 and second primary end 24 of the garment bag 1 over the general purpose bag such that the first and second primary ends meet at approximately the middle of the top portion 206 of the general purpose bag 200. Because of the arcuate shape 29 on the first 23 and second 24 primary ends, the gap 70 is formed approximately over the middle of the top portion 206 of the general purpose bag 200 and the carrying assembly 208. In such a position, first portion 150*a* of the first 150 combination mating assembly on the garment bag 1 and the second portion 150*b* of the first 150 combination mating assembly on the general purpose bag 200 are each in locations for cooperative interaction. The user then joins the first 150 combination mating assembly to at least partially secure the garment bag 1 and the general purpose bag 200 together. In one embodiment, the combination mating assembly 150 is secured such that it at least partially extends under the carrying assembly 218. Furthermore, if desired, the carrying assembly may be extended through gap 70 such that the combination may be carried using the carrying assembly. Alternatively, a shoulder strap 270 (shown joined to only 1 receiver in FIG. 8B) may be reversibly joined to receivers 35 and the combination carried using the shoulder strap 270 (FIGS. 8B to 8C).

As shown in FIG. 8C, the first interior space 6 and the second interior space 214 are completely separate from one another. No part of the garment bag 1 forms the second interior space 214 in the general purpose bag 200 and not part of the general purpose bag 200 font's part of the first interior space 6 in the garment bag 1. Furthermore, when in combination as described, no part of the general purpose bag 200 is contained within the first interior space 6 of the garment bag 1 and no portion of the garment bag is contained within the second interior space 214.

In the form shown in FIG. 8B, the garment bag 1 and general purpose bag 200 are reversibly secured together through three points of contact. Further, the ends of the garment bag are secured to one another through two points of contact. When the garment bag and the general purpose bag are present in the combinations as described herein, the garment bag is in a compact configuration.

Certain preferred configurations of the compact configuration are described below. In one embodiment, the garment bag and general purpose bag are reversibly joined through at least two points of contact, in a particular embodiment, three points of contact. In one embodiment, the ends of the garment bag are reversibly secured to one another through at least one point of contact, in a particular embodiment, two points of contact. In one embodiment, the garment bag at least partially surrounds the general purpose bag. In one embodiment, the first interior space of the garment bag at least partially surrounds the second interior space of the general purpose bag and is separate from the second interior space. In one embodiment, the first interior space of the garment bag is not contained within the second interior space of the general purpose bag. In one embodiment, the second interior space of the general purpose bag is not contained within the first interior space of the garment bag. In one embodiment, the garment bag partially surrounds the general purpose bag with the outer side of the interior panel of the garment bag contacting the bottom panel and at least portions of the first and second side panels of the general purpose bag and optionally the top panel of the general purpose bag. In another embodiment, the garment bag does not cover or obscure the first and second end panels of the general purpose bag; in a particular embodiment the garment bag does not cover or obscure more than 10% of the surface area of the first and second end panels of the general purpose bag. In another embodiment, the gap formed by the first and second primary ends (when one or both of such ends adopt an arcuate configuration) is present generally above the top panel of the general purpose bag; in a particular embodiment, the gap is present in a position that the handle assembly of the general purpose bag can be accessed through the gap. In another embodiment, the outer side of the interior panel of the garment bag contacts at least 90% of the bottom panel of the general purpose bag. In another embodiment, the outer side portion 42*a* of the interior panel contact one of the side panels of the general purpose bag and the outer side portion 42*b* of the interior panel contact the other of the side panels of the general purpose bag and portions 42*a* and 42*b* of the interior panel do not contact one another except optionally at the first and second interior ends (43 and 44) (see for example, FIG. 4A and 8A-C). The features of the foregoing embodiments may be combined in any manner In another embodiment, the length of the luggage combination, with the garment bag in the compact configuration, is less than the linear length of the garment bag. In another embodiment, the length of the luggage combination, with the garment bag in the compact configuration, is approximately equal to or equal to the width of the garment bag; by approximately equal to as used in this sentence, it is meant at least 90%.

In one embodiment, in the compact configuration the garment bag and the general purpose bag are secured to one another by at least three points of contact, where two points of contact on the general purpose bag are located the first and second side panels of the general purpose bag. In one embodiment, in the compact configuration the garment bag and the general purpose bag are secured to one another by at least three points of contact where two points of contact on the general purpose bag are located on the bottom panel of the general purpose bag. In one embodiment, in the compact configuration the garment bag and the general purpose bag are secured to one another by at least three points of contact where two points of contact on the general purpose bag are located on the bottom panel of the general purpose bag and/or the first and second side panels of the general purpose bag.

In one embodiment, in the compact configuration the garment bag and the general purpose bag are secured to one another by at least three points of contact, where two points of contact on the garment bag are located on the primary panel of the garment bag. In one embodiment, in the compact configuration the garment bag and the general purpose bag are secured to one another by at least three points of contact, where two points of contact on the garment bag are located on the exterior face of the primary panel of the garment bag. In one embodiment, in the compact configuration the garment bag and the general purpose bag are secured to one another by at least three points of contact where two points of contact on the garment bag are located on the interior face of the primary panel of the garment bag. In one embodiment, in the compact configuration the garment bag and the general purpose bag are secured to one another by at least three points of contact where two points of contact on the garment bag are located on exterior face of the primary panel and/or the interior face of the primary panel of the garment bag.

In one embodiment, in the compact configuration the garment bag and the general purpose bag are secured to one another by at least three points of contact wherein two of the at least three points of contact on the garment bag are each separated by a distance of 12 inches or more (such as 15 inches or 18 inches) and less than or equal to 20 inches. In one embodiment, in the compact configuration the garment bag and the general purpose bag are secured to one another by at least three points of contact wherein two of the at least three points of contact on the general purpose bag are each separated by a distance of 8 inches or more (such as 10 inches or 15 inches) and less than or equal to 15 inches.

What is claimed is:

1. A luggage combination comprising a garment bag and a general purpose bag adapted to be reversibly secured to one another to form a compact configuration:

a. the garment bag comprising:
   i. a primary panel having an exterior face, an interior face, first and second primary ends and first and second primary edges;
   ii. an interior panel have an inner side, an outer side, first and second interior ends and first and second interior edges, the interior panel permanently joined to the primary panel in at least one point;
   iii. a first interior space formed by the primary panel and the interior panel;
   iv. a first reversibly sealable opening to access the first interior space;
   v. a first portion and a second portion of a first garment bag mating assembly secured to the primary panel of the garment bag at or adjacent to the first and second primary ends, respectively, such that the first and second portions of the first garment bag mating assembly are positioned to allow their cooperative interaction;
   vi. a first portion of a first combination mating assembly secured to the garment bag at or adjacent to one of the first or second primary end; and
   vii. a first portion of a second combination mating assembly secured to the garment bag at or adjacent to one of the first or second primary edges;

b. the general purpose bag comprising:
   i. a first end panel, a second end panel, a top panel, a bottom panel, a first side panel and a second side panel defining a second interior space;
   ii. at least one reversibly sealable opening to access the second interior space;
   iii. a carrying assembly;
   iv. a second portion of the first and second combination mating assemblies secured to the general purpose bag, the second portion of the first combination mating assembly is secured to the top panel, and the second portion of the second combination mating assembly is secured to one of the first or second end panels, such that the first and second portions of the first and second combination mating assemblies are positioned to allow their cooperative interaction;

wherein the first and second primary or interior ends of the garment bag are reversibly secured to one another by the interaction of the first and second portions of the first garment bag mating assembly and the garment bag is reversible secured to the general purpose bag by the interaction of the first and second portions of the first and second combination mating assemblies and wherein the outer side of the interior panel contacts each of the bottom panel, first side panel and second side panel of the general purpose bag.

2. The luggage combination of claim 1, wherein the primary panel is secured to the interior panel.

3. The luggage combination of claim 1, wherein one of the first or second interior edge of the interior panel is reversibly secured to the interior face of the primary panel at or adjacent to one of the first or second primary edges.

4. The luggage combination of claim 1, further comprising a second reversibly sealable opening to access the first interior space.

5. The luggage combination of claim 4, wherein the primary panel is permanently secured to the interior panel at at least one point and the primary panel is reversibly secured to the interior panel at at least one point.

6. The luggage combination of claim 4, wherein the interior panel is permanently secured to the interior face of the primary panel at or adjacent the first primary edge and the second interior edge of the interior panel is reversibly secured to the interior face of the primary panel at or adjacent to the second primary edge.

7. The luggage combination of claim 1, wherein the first portion of the first combination mating assembly is located on a tab secured to the first primary end at or adjacent to a midpoint of the first primary end.

8. The luggage combination of claim 7, wherein the tab further comprises a securing element and a carrying element.

9. The luggage combination of claim 7, wherein one or both of the first and second primary ends has an arcuate shape so as to define a gap.

10. The luggage combination of claim 9, wherein the tab extends into the gap between the first and second primary ends and underneath the carrying assembly when the first and second portions of the first combination mating assembly are joined to one another.

11. The luggage combination of claim 1, further comprising a protective flap comprising an upper edge, a lower edge and an opening along a portion of the upper edge, the upper edge of the protective flap securely joined to the interior face of the primary panel at or adjacent to the first primary end and the lower edge of the protective flap reversibly secured to the exterior face of the interior panel at or adjacent to the first interior end.

12. The luggage combination of claim 11, wherein the opening is located at or adjacent to a midpoint of the first primary end.

13. The luggage combination of claim 1, further comprising a first portion and a second portion of a second garment bag mating assembly secured to the garment bag and the first and second primary or interior ends of the garment bag are reversibly secured to one another by the interaction of the first and second portions of the first and second garment bag mating assemblies, wherein the first portions of the first and second garment bag mating assemblies are secured to the primary panel at or adjacent to the first primary end, the second portions of the first and second garment bag mating assemblies are secured to the primary panel at or adjacent to the second primary end, the first portion of the first combination mating assembly is secured to the primary panel of the garment bag at or adjacent to one of the first or second primary ends between the first portions of the first garment bag mating assembly, the first portion of the second combination mating assembly is secured to the primary panel of the garment bag at or adjacent to the one of the first or second primary edges, the second portion of the first combination mating assembly is secured to the top panel of the general purpose bag, and the second portion of the second combination mating assembly is secured to one of the first or second end panels of the general purpose bag, wherein the first and second portions of the first and second garment bag mating assemblies and the first and second portions of the first and second combination mating assemblies are positioned to allow their cooperative interaction.

14. The luggage combination of claim 13, wherein the first and second portions of the first and second garment bag mating assemblies are secured to the primary panel at or adjacent to the primary upper corners and the primary lower corners, respectively, and the first portion of the first combination mating assembly is located on a tab secured to the first primary end at or adjacent to a midpoint of the first primary end.

15. The luggage combination of claim 14, wherein the tab further comprises a securing element and a carrying element.

16. The luggage combination of claim 14, wherein one or both of the first and second primary ends has an arcuate shape so as to define a gap.

17. The luggage combination of claim 16, wherein the tab extends into the gap between the first and second primary ends and underneath the carrying assembly when the first and second portions of the first combination mating assembly are joined to one another.

18. The luggage combination of claim 13, further comprising a protective flap comprising an upper edge, a lower edge and an opening along a portion of the upper edge, the upper edge of the protective flap securely joined to the interior face of the primary panel at or adjacent to the first primary end and the lower edge of the protective flap reversibly secured to the exterior face of the interior panel at or adjacent to the first interior end.

19. The luggage combination of claim 18, wherein the opening is located at or adjacent to a midpoint of the first primary end.

20. The luggage combination of claim 1, wherein the garment bag further comprises a first portion and a second portion of a second garment bag mating assembly secured to the garment bag and a first portion of a third combination mating assembly secured to the garment bag and the general purpose bag further comprises a second portion of the third combination mating assembly secured to the general purpose bag and the first and second primary or interior ends of the garment bag are reversibly secured to one another by the interaction of the first and second portions of the first and garment bag mating assemblies and the garment bag is reversible secured to the general purpose bag by the interaction of the first and second portions of the first, second and third combination mating assemblies, wherein the first portions of the first and second garment bag mating assemblies are secured to the primary panel at or adjacent to the first primary end, the second portions of the first and second garment bag mating assemblies are secured to the primary panel at or adjacent to the second primary end, the first portion of the first combination mating assembly is secured to the primary panel of the garment bag at or adjacent to one of the first primary end between the first portions of the first garment bag mating assembly, the first portion of the second combination mating assembly is secured to the primary panel of the garment bag at or adjacent to the first primary edge, the first portion of the third combination mating assembly is secured to the primary panel of the garment bag at or adjacent to the second primary edge, the second portion of the first combination mating assembly is secured to the top panel of the general purpose bag, the second portion of the second combination mating assembly is secured to the first end panel of the general purpose bag and the second portion of the third combination mating assembly is secured to the second end panel of the general purpose bag, wherein the first and second portions of the first and second garment bag mating assemblies and the first and second portions of the first, second and third combination mating assemblies are positioned to allow their cooperative interaction.

21. The luggage combination of claim 20, wherein the first and second portions of the first and second garment bag mating assemblies are secured to the primary panel at or adjacent to the primary upper corners and the primary lower corners, respectively, and the first portion of the first combination mating assembly is located on a tab secured to the first primary end at or adjacent to a midpoint of the first primary end.

22. The luggage combination of claim 21, wherein the tab further comprises a securing element and a carrying element.

23. The luggage combination of claim 21, wherein one or both of the first and second primary ends has an arcuate shape so as to define a gap.

24. The luggage combination of claim 23, wherein the tab extends into the gap between the first and second primary ends and underneath the carrying assembly when the first and second portions of the first combination mating assembly are joined to one another.

25. The luggage combination of claim 20, further comprising a protective flap comprising an upper edge, a lower edge and an opening along a portion of the upper edge, the upper edge of the protective flap securely joined to the interior face of the primary panel at or adjacent to the first primary end and the lower edge of the protective flap reversibly secured to the exterior face of the interior panel at or adjacent to the first interior end.

26. The luggage combination of claim 25, wherein the opening is located at or adjacent to a midpoint of the first primary end.

27. The luggage combination of claim 1, wherein the garment bag has a width defined by the distance between the first and second primary sides and the general purpose bag has a length defined by the distance between the first and second ends, where the length of the general purpose bag is no less than 80% of the width of the garment bag.

28. The luggage combination of claim 1, wherein the length of the general purpose bag is substantially equal to the width of the garment bag.

29. The luggage combination of claim 1, wherein second interior space is formed without the participation of the primary and interior panels.

30. The luggage combination of claim 1, wherein the garment bag wraps around the general purpose bag without forming an acute angle in the garment bag.

31. The luggage combination of claim 30 that eliminates or reduces wrinkles in an item of clothing contained in the garment bag.

32. The luggage combination of claim 1, wherein the primary panel of the garment bag comprises a middle primary panel comprising a first break point and the bottom panel of the general purpose bag optionally comprises a second break point.

* * * * *